US006268828B1

(12) United States Patent
Martek

(10) Patent No.: US 6,268,828 B1
(45) Date of Patent: Jul. 31, 2001

(54) CYLINDRICAL ANTENNA COHERENT FEED SYSTEM AND METHOD

(75) Inventor: Gary A. Martek, Edgewood, WA (US)

(73) Assignee: Metawave Communications Corporation, Redmond, WA (US)

( * ) Notice: Subject to any disclaimer, the term of this patent is extended or adjusted under 35 U.S.C. 154(b) by 0 days.

(21) Appl. No.: 09/481,267

(22) Filed: Jan. 11, 2000

(51) Int. Cl.[7] ..... H01Q 3/22; H01Q 3/24; H01Q 3/26

(52) U.S. Cl. ..... 342/373; 343/853; 343/890; 343/893

(58) Field of Search ..... 342/373; 343/853, 343/890, 893

(56) References Cited

U.S. PATENT DOCUMENTS 4,425,567 * 1/1984 Tresselt ..... 342/373

* cited by examiner

*Primary Examiner*—Theodore M. Blum
(74) *Attorney, Agent, or Firm*—Fulbright & Jaworski L.L.P.

(57) ABSTRACT

Systems and methods are disclosed for illuminating multiple columns of antennas to provide a desired wave front without introducing non-coherent combining. The preferred embodiment feed network provides elevation scanning for a multiple beam antenna system on a per antenna beam basis. In a preferred embodiment columns of antenna elements are divided into phase-centers having a relative phase shift introduced there between. Phase differentials are introduced into the antenna beam signals of each phase-center of antenna elements in order to provide a phase progression which steers the antenna beam a predetermined angle from the broadside. The phase differentials are independently provided for each antenna beam signal to thereby allow independent steering of each antenna beam.

38 Claims, 14 Drawing Sheets

CYLINDRICAL ANTENNA COHERENT FEED SYSTEM AND METHOD

RELATED APPLICATIONS

REFERENCE TO RELATED APPLICATION

The present application is related to commonly assigned U.S. application Ser. No. 09/034,471, now U.S. Pat. No. 6,188,373, entitled "SYSTEM AND METHOD FOR PER BEAM ELEVATION SCANNING," filed Mar. 4, 1998 which is a continuation-in-part of commonly assigned U.S. application Ser. No. 08/808,304 now U.S. Pat. No. 6,094,166, entitled "CONICAL OMNI-DIRECTIONAL COVERAGE MULTIBEAM ANTENNA WITH MULTIPLE FEED NETWORK," filed Feb. 28, 1997, itself a continuation-in-part of and commonly assigned U.S. application Ser. Nos. 08/680,992, now U.S. Pat. No. 5,940,048, entitled "CONICAL OMNI-DIRECTIONAL COVERAGE MULTIBEAM ANTENNA," filed Jul. 16, 1996, the disclosures of each of which are incorporated herein by reference.

TECHNICAL FIELD

This invention relates generally to a multibeam antenna array and more particularly to a system and method for providing coherent combining for beam forming, for providing elevation beam scanning on a per beam basis, and for providing sidelobe level control for the antenna beams of the array.

BACKGROUND

Planar array antennas when imposed to cover multiple directions, suffer from scan loss. Since the projected aperture decreases as the beam is steered away from the broadside position which is normal to the ground surface and centered to the surface itself, it follows then that broadside excitation of a planar array yields maximum aperture projection. Accordingly, when such an antenna is made to come off the normal axis, the projected aperture area decreases causing a scan loss which is a function of cosine having a value of 1 with the argument of zero radians (normal) and having a value of 0 when the argument is $$\frac{\pi}{2}.$$

$$\text{Ant Gain db} = 10\log\left[\frac{4\pi}{\lambda^2} * \text{Area} * \text{Cos}(\theta)\right]$$

The multiple antenna beams of a communication system may be generated through use of a planar or cylindrical array of antenna elements, by providing signals to the individual antenna elements with a predetermined phase relationship (i.e., a phased array). This phase relationship causes the signal simulcast from the various antenna elements of the array to destructively and beneficially combine to form the desired radiation pattern. There are a number of methods of beam forming using matrix type beam forming networks, such as Butler matrixes commonly used in prior art systems. Likewise, there are a number of methods of beam steering using matrix type beam forming networks that can be made to adjust parameters as directed from a computer algorithm. This is the basis for adaptive arrays.

When a linear planar array is excited uniformly to produce a broadsided beam projection, the composite aperture distribution resembles a rectangular shape. When this shape is Fourier transformed in space, the resultant pattern is laden with high level side lobes relative to the main lobe. The $$\text{SINC} = \frac{\text{SIN}(x)}{(x)}$$

function is thus produced in the far-field pattern. In most practical applications these high level side lobes are an undesirable side effect.

Cylindrical arrays may be preferable to a planar array due to the symmetry of a cylindrical antenna array providing improved side lobe level control as each antenna beam may be substantially orthogonal to a portion of the broadside of a cylindrical antenna system. Accordingly, if adapted properly, such a system may be utilized to provide superior antenna beam forming, i.e., substantially reduced scan loss and side lobes, for example, over that provided by a planar array.

Interference experienced in wireless communication, such as may be caused by multiple users of a particular service and/or various radiating structures of a service or different services providing communication coverage within the same or different geographical areas, may be controlled, at least to a limited extent, through antenna beam side lobe control. Through side lobe control, substantially only desired areas may be included in the antenna beam, thus avoiding energy radiated from undesired directions in the receive link and radiating energy in undesired directions in the transmit link. However, often in the past antenna beam side lobe control has been accomplished through the removal of antenna elements in outer columns of the phased array. However, this solution is generally not possible in a cylindrical array as the outer columns of one beam are the inner columns of another beam and, thus, removal of these elements would adversely affect beam formation.

As the use of wireless communications increases, such as through the deployment of new services and/or the increased utilization of existing services, the need for interference reduction schemes, such as techniques for reducing the aforementioned side lobes, becomes more pronounced. Further control of interference and improvement in communications may be had through steering antenna beams not only in the azimuth, but also in the elevation, to direct an antenna beams to a user and/or to isolate other user's signals.

For example, in code division multiple access (CDMA) networks a number of communication signals, each associated with a different user or communication unit, operate over the same frequency band simultaneously. Each communication unit is assigned a distinct, pseudo-random, chip code which identifies signals associated with the communication unit. The communication units use this chip code to pseudo-randomly spread their transmitted signal over the allotted frequency band. Accordingly, signals may be communicated from each such unit over the same frequency band and a receiver may despread a desired signal associated with a particular communication unit.

However, despreading of the desired communication unit's signal results in the receiver not only receiving the energy of this desired signal, but also a portion of the energies of other communication units operating over the same frequency band. Accordingly, CDMA networks are interference limited, i.e., the number of communication units using the same frequency band, while maintaining an acceptable signal quality, is determined by the total energy level within the frequency band at the receiver. Therefore, it is desirable to limit reception of unnecessary energy at any of the network's communication devices.

In the past, interference reduction in some wireless communication systems, such as the aforementioned CDMA cellular systems, has been accomplished to an extent through physically adjusting the antenna array to limit radiation of signals to within a predefined area. Accordingly, areas of influence of neighboring communication arrays may be defined which are appreciably smaller than the array is capable of communicating in. As such, radiation and reception of signals is restricted to substantially only the area of a predefined, substantially non-overlapping, cell.

Changes in the environment surrounding a communication array or changes at a neighboring communication array may require adjustment of the radiation pattern of a particular communication array. Specifically, seasonal changes around a base transceiver station (BTS) site can cause changes in propagation losses of the signal radiated from a BTS. For example, during fall and winter deciduous foliage loss can cause a decrease in signal path loss. This can result in unintentional interference into neighboring BTS operating areas or cells as the radiation pattern of the affected BTS will effectively enlarge due to the reduced propagation losses.

Likewise, an anomaly affecting a neighboring BTS may cause an increase in signal path loss, or complete interruption in the signal, therefore necessitating the expansion of the radiation patterns associated with various neighboring BTSes in order to provide coverage in the affected areas.

Previously, crews have had to be dispatched to purposely tilt BTS antennas up or down to minimize interference or provide coverage in neighboring areas. Likewise, crews have again had to be dispatched when the anomaly affecting the signal has dissipated or been resolved. Such adjustment is typically accomplished in concert with observation of field measurement, such as may be available from drive testing or by the results of operation statistical records. It becomes readily apparent that compensation for such anomalies, even occurring only seasonally, can be quite expensive. Furthermore, as the communication system grows in complexity, more such adjustments have to be made to bring the system back up to full operating capacity.

Additionally, it may be desirable to independently adjust the beams. For example, the aforementioned anomaly affecting radiation of signals may affect only certain antenna beams of an array and, therefore, only a subset of the antenna beams require adjustment. Likewise, adjustment of only a selected antenna beam in order to provide communication to a particular mobile communication unit may be desirable. However, it is not common for current systems to provide for the adjustment of individual antenna beams of an antenna array due to the complexity of adaptation of prior art feed networks in order to provide such per antenna beam steering. For example, adapting the aforementioned Butler matrixes of the prior art, which provide the phase progressions of multiple ones of the antenna beams formed by such a phased array system, to allow individual antenna beam elevation steering is very difficult, if not impossible.

Accordingly, a need exists in the art for a system and method providing improved antenna beam forming to direct communication signals to/from subscriber units substantially to the isolation of other signals.

A further need exists in the art for a system and method providing antenna beam forming utilizing efficient circuitry to enable establishing a phased array signal without unnecessary signal power losses such as associated with non-coherent combining in an antenna feed network.

A still further need exists in the art for a system and method providing individual elevation "down-tilt" of antenna beams providing illumination of a desired area in order to reduce interference and allow frequency reuse by additional such antenna systems.

A yet further need exists in the art for a system providing antenna beam side lobe control without unnecessarily compromising the ability to form adjacent antenna beams.

SUMMARY OF THE INVENTION

These and other objects, features and technical advantages are achieved by a system and method which utilizes the simple geometry of conical shapes to provide a more natural beam steering. In a preferred embodiment of the invention, an antenna, providing transmit, receive, or both, such as by utilizing duplexing circuitry, is constructed as a series of antenna dipole columns mounted in close proximity to the outer surface of a nearby vertical conical shaped electrical ground surface. The ground surface is constructed circumferentially around a mast and the conical "slope" and is such that the ground surface "faces" downward at an angle, thereby creating on the ground a circumference within which the signal is propagated. This entire structure is preferably contained within a single transparent radome. The ground surface angle, or conical angle can be adjusted to contain or limit the coverage area of the intended radiation pattern.

When a group of columns are excited to create a beam, the positive result from this structure is created by the fact that the reflected "image" energy from the outer columns is dispersed when the radius of the ground surface cylinder is in the range of one $\lambda$ wavelength. So, when the various parallel ray paths are summed together to make the effective aperture distribution, the shape is close to a cosine function and the spatial transform is similar to a Gaussian shaped far-field pattern. Thus, the antenna system achieves lower side lobes in relation to the main lobe, which in most practical cases, is a desirable effect.

To further improve side lobe level control, the antenna feed matrix of a preferred embodiment of the present invention does not excite all antenna elements of the outer columns utilized in forming a desired antenna beam to provide a tapered aperture. However, as the preferred embodiment cylindrical antenna structure provides no true outer columns, but rather only outer columns of those excited for particular antenna beams, the preferred embodiment antenna feed network does not require modifications to be made to the outer array columns to effect side lobe level control.

In one embodiment, the individual columns can consist of any type of radiator: patch, dipole, helical coil, etc. In the case of dipoles elevated above the grounded surface of the cylinder, the effect can be visualized as a circular patch being projected onto a curved surface where the reflected projection is an ellipse with the major axis of the ellipse being a function of the radius used to make up the cylinder. As that radius increases, the amount of dispersion decreases such that as the radius grows to infinity, the system behaves like the common linear planar array. The first side lobe grows in magnitude converging on the value of that seen with a uniformly excited linear array. So, the level of first side lobe leveling control is a function of the radius of the cylinder. Using this as the design objective, the radius of the preferred embodiment should be limited to a value of $$< \frac{3}{2} * \lambda.$$

In some applications, it is desirable to limit the radiation pattern of the antenna system so that a network of such systems can reuse an allocated set of frequencies repeatedly. The cylinder used as an example, could be replaced with a conic section that would be a "frustum of right circular cone". The larger radius of the two radii of the frustum, would be at the top, when mounted longitudinally. This would accommodate the "down-tilt" required for such a system. Other shapes can be used, such as right circular cones or semi-hemispheres to encompass airborne and space applications as well as terrestrial applications.

To provide further desired control of antenna beam down-tilt, a preferred embodiment of the present invention utilizes an antenna feed network which provides an amount of phase shift as between upper ones of the antenna elements and the lower ones of the antenna elements energized in forming a desired antenna beam. Accordingly, the antenna arrays are preferably divided into distinct "phase-centers" so that a relative relationship can be established between these phase-centers.

Preferably, the phase-centers are associated with subdivisions of columns of antenna elements. Therefore, according to a preferred embodiment of the present invention, delays are introduced in the signals provided to ones of the antenna elements forming an antenna column. These delays set up a differential phase shift between the antenna elements. In the case where it is desired to have the antenna beam "look down" (down-tilt), the upper antenna elements of the column are advanced in phase in relationship to the lower antenna elements of the column. When the radiation of the upper elements is combined with the phase delayed energy of the lower portion of the column, the entire beam is steered down.

Through in service control of this phase shift, such electrical down-tilting of the antenna beams may be accomplished dynamically. Accordingly, a most preferred embodiment of the present invention utilizes an antenna feed network with adjustable phase shifters to provide a controllable amount of phase shift as between signals provided to upper and lower antenna elements. Accordingly, a system operator or system controller, such as embodied in a computer system having suitable inputs for monitoring communication attributes and suitable outputs for operating the adjustable phase shifters as a function of the communication attributes, may choose a desired down-tilt by selecting the appropriate delays or phase shifts to be introduced between the antenna elements of the columns associated with the antenna beam to be adjusted.

Selection of a particular down-tilt by the system operator or system controller preferably includes consideration of system wide interference levels, such as a determination of a particular amount of down-tilt at a cell site to provide adequate communications within a particular geographic area without accepting and/or introducing undesired energy from/into neighboring cells. For example, in a preferred embodiment, the introduction of selected delays are automated to provide for adjustment of down-tilt without substantial human intervention. Accordingly, a system controller may monitor communication conditions, including interference levels, at a particular base site or number of base sites and automatically adjust down-tilt to achieve desired communication attributes. Of course, introduction of the selected delays may be through such manual means as a system technician physically altering phase shifters and/or signal paths, if desired.

The antenna feed network of a preferred embodiment is adapted to not only provide elevation steering of the antenna beams, but to provide such steering for ones of the antenna beams independently from other ones of the antenna beams. Most preferredly the antenna feed network utilizes a minimum number of active components, such as the above mentioned phase shifters, in combination with the efficient use of passive devices, such as signal splitters and/or hybrid combiners, in order to provide the desired individual antenna beam elevation steering in an efficient and simplified manner.

Additionally, in order to provide for antenna beam forming which efficiently utilizes signal level power as provided thereto, the preferred embodiment antenna feed network is coupled to antenna elements of the antenna structure so as to provide for coherent combining or avoid non-coherent combining. Accordingly, signal power level losses on the order of 3 dB associated with non-coherent combining of signals is avoided. A further advantage of this preferred embodiment is that less costly components may be utilized in the antenna beam forming network, such as inexpensive signal combiners rather than combiners including beryllium oxide insulators to dissipate the heat created by non-coherent transmit combining.

Preferably, the antenna feed network of the present invention is adapted to provide aperture tapering in order to improve antenna beam characteristics, such as reduce undesired side and grating lobes. Accordingly, a preferred embodiment antenna feed network is adapted to provide a signal component of lesser magnitude to outer antenna elements, left and right edge and/or upper and lower edge, of those energized to form an antenna beam.

A preferred embodiment of the present invention utilizes multiple conical antenna structures to provide alternating antenna beams throughout an area to be serviced in order to provide the coherent combining as well as to accommodate a desired number of substantially non-overlapping narrow antenna beams.

Beam width and gain are functions of how many radiator columns are driven at the same time from one excitation source, accordingly the antenna feed network of the present invention is adapted to couple a selected group and number of antenna elements with a particular antenna beam signal port to provide a desired antenna beam. Any number of columns can be excited to effect the desired beam synthesis. The only requirement is that the active (excited) columns, can "see" the projected wave front that it is supposed to participate in. This would determine the maximum number of columns required to effect a specific beam synthesis. The highest gain, narrowest beam is produced when all Pi radian active elements that are driven together can "see" the wave front that they are each to participate in. In the case of a cylinder, these would be the columns that are Pi apart on the circumference. A line drawn between the most outer and most inner columns, sets up the basis upon which the inner columns are phase retarded in order to produce the desired beam synthesis. However, a simulcast on all beams is possible if all "N" ports are excited at the same time.

The intended beam design objectives are based on the number of available adjacent columns to be excited. The narrower the beam, the more columns excited, and the more complex the phase retardation network. The simplest approach, is to disregard the image sources projecting off the ground surface and simply introduce the appropriate amount of phase shift on the inner columns to effect a "coherent" phase front in the direction of beam propagation. In this first approach, this works to create a useful pattern. However, the best gain and side lobe relationship is achieved when image source dispersion is taken into account. After the image sources have been adjusted for dispersion factor and ray trace length, a composite delay is assigned to the inner columns.

It shall be appreciated from the above that a technical advantage of the present invention is to provide elevation beam steering useful in reducing interference and allowing frequency reuse throughout a wireless communication system. A further technical advantage is realized in the present invention's ability to provide independent elevation steering of multiple beams of a single antenna array.

A further technical advantage of the present invention is provided by the system and method providing an efficient beam forming network reducing signal power loss associated with non-coherent combining of signals.

A still further technical advantage of the present invention is provided by the antenna beam forming feed network being adapted to provide for aperture tapering to thereby control side lobe levels without requiring modification of the antenna columns.

Additionally, a technical advantage is provided by the present invention's ability to operate automatically, responsive to current wireless communication system operating conditions.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1:
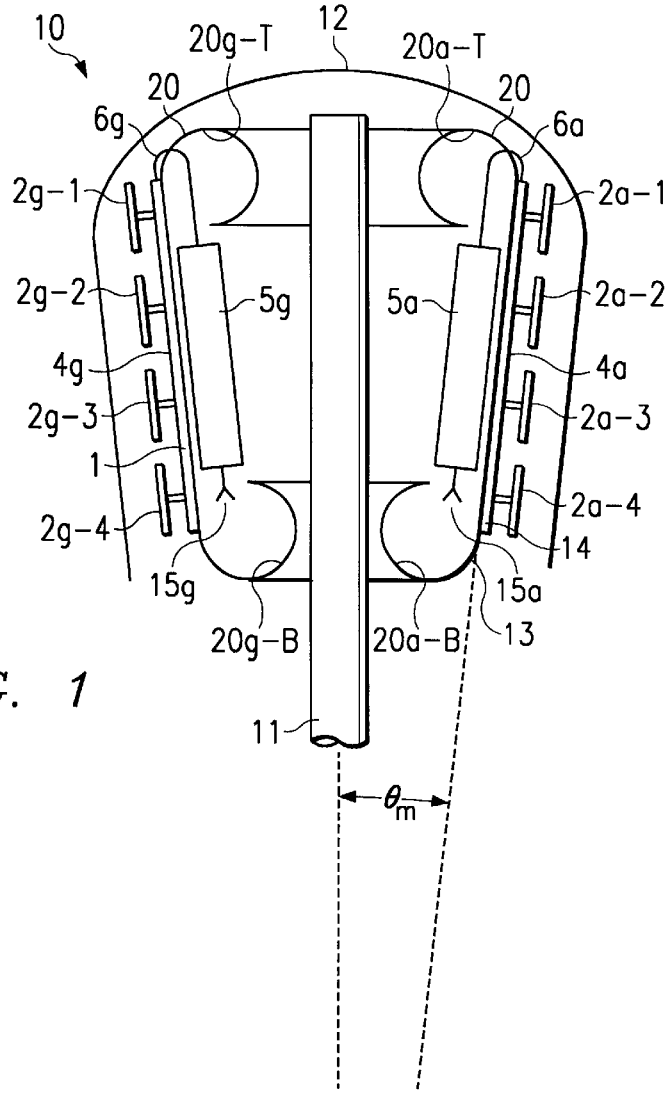
FIG. 1 illustrates a conical multi-beam antenna array suitable for use according to the present invention.
Figure 2A:
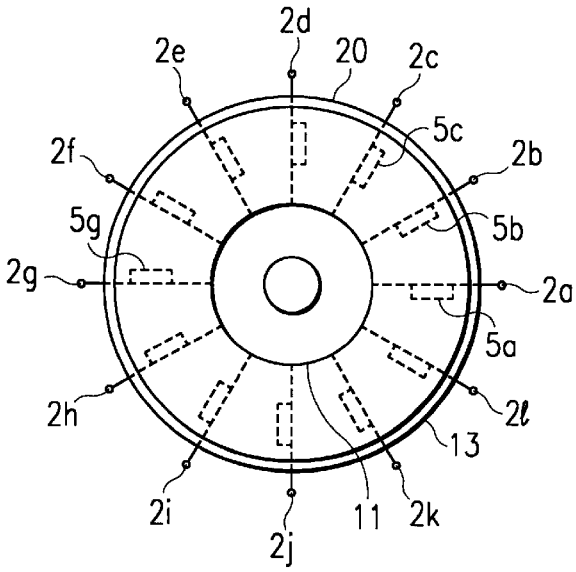
FIG. 2A illustrates a top view of the conical antenna array of FIG. 1.
Figure 2B:
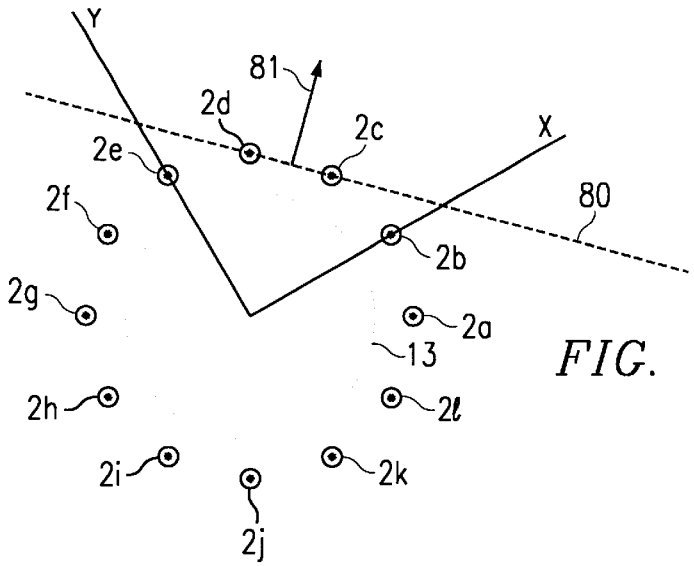
FIGS. 2B–2D are phase relationship diagrams.
Figure 4:
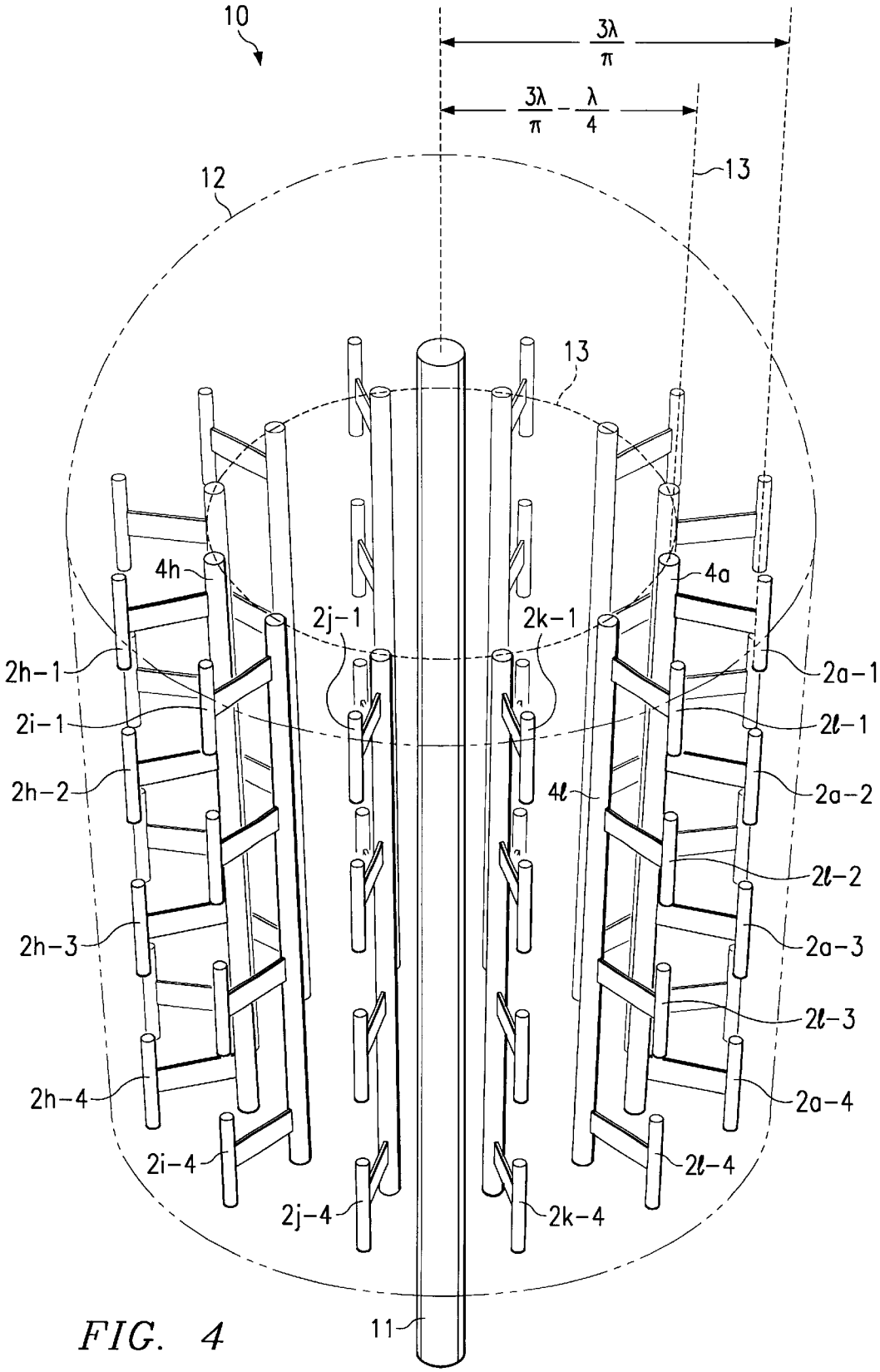
FIG. 4 is a full elevational view of the antenna system shown in FIG. 1.

As shown in FIG. 1, a preferred embodiment of antenna system 10 utilized according to the present invention is shown having a conical shaped ground surface 13 held by mast 11. Ground surface 13 may act as a circumferential support for column radiators 2*a*–2*l* which are arranged around the peripheral of surface 13, as shown in FIG. 2A. FIG. 4 shows a perspective view of antenna system 10. In the example shown, there are twelve vertical column radiators (2*a*–2*l*), each having 4 dipoles in this case, such as dipoles 2*a*-1, 2*a*-2, 2*a*-3 and 2*a*-4 for column 2*a* (FIG. 1). The column radiators are joined together by mounting them on a support structure, such as may include a feed system, such as feed system 4*a* for radiator set 2*a*and feed system 4*g* for radiator 2*g* which in turn is connected by a signal path, such as a coaxial connector, 6*a*–6*l* which feeds through the wall of conical ground surface 13 to a portion of an antenna beam forming network associated with the antenna column, e.g. beam former 5*a* associated with column 2*a* and beam former 5*g* associated with column 2*g*. Antenna beam signals are provided through beam former connectors, such as connector 15*a* and 15*g*.

As will be appreciated from the detailed discussion with respect to a preferred embodiment antenna beam forming network below, beam formers such as beam former 5*a* may not be associated with a single antenna column, but rather with a number of antenna columns determined to provide a desired antenna beam, such as an antenna beam having a desired azimuthal beam width. Accordingly, although the illustrations of FIGS. 1–3 do not show signal paths between the beam formers of the antenna beam forming network and multiple ones of the antenna columns, multiple ones of the antenna columns may be energized by a signal input at an antenna beam former connector. Moreover, although illustrated as independent beam formers, the circuitry of the preferred embodiment providing the desired beam forming may in fact be shared among multiple ones of the beam formers.

Ground surface 13 is shown as a frustum of a right circular cone having angle $\Theta_M$ with mast 11. This angle $\Theta_M$ is a mechanical down-tilt angle and controls, at least in part the area of coverage and facilitates the reuse of frequencies.

The mechanical $\Theta_M$ is established by the physical structure of the right circular cone. This $\Theta_M$ can be supplemented by a $\Theta_E$, which is an electrical down-tilt created by the relative phase relationship among the dipoles making up the vertical column, to give a total angle of down-tilt. $\Theta$ as shown below.

$$\Theta=\Theta_M+\Theta_E$$

Angle $\Theta$ could be variable, for example by tilting mast 11 or varying the shape of ground surface 13, from time to time, to allow for changing conditions. Additionally or alternatively angle $\Theta$ could be varied by adjusting the relative phase relationship among the dipoles of the vertical columns. A cylinder can be used if the radiator columns are fed in such a way that the individual radiating elements making up the column radiator have the appropriate inter-element phase relationship that produces the desired amount of down-tilting (where down-tilt is desired). Of course this would, in theory, introduce a small amount of "scan-loss" so the use of the physical method of down-tilt, at least in part, may be preferred since it would project the greater amount of aperture area.

The principle of antenna system 10 is to generate a wave front by the excitation of the appropriate radiator columns 2*a*–2*l* and by phase shifting (delaying) the "inner" column radiators. For example, to synthesize the creation of a planar wave front, referring to FIG. 2B, radiator columns 2*c* and 2*d* are phase retarded by 90° with respect to columns 2*b* and 2*e*. The combined wave front 80 adds in the direction of arrow 81 to produce a planar wave front.

Figure 2C:
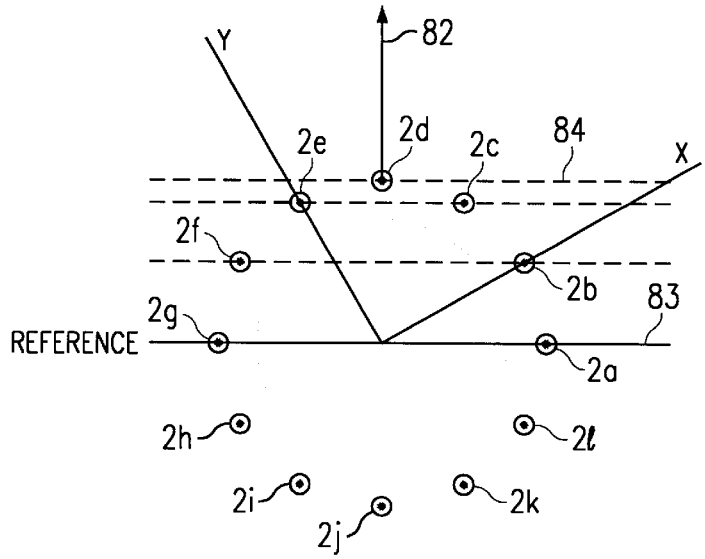

For more columns to be driven, the inner columns (those closest to the wave front) must be delayed in single or in pairs, to match the phase of the most outer column elements. Referring to FIG. 2C, seven radiator columns (2*a*through 2*g*) are involved in generating a wave front in the direction of arrow 82. Accordingly, column 2*d*'s excitation is retarded by the angular displacement with respect to a line 83 drawn through points 2*g*–2*a*and its advance parallel line 84 through point 2*d*. Likewise, columns 2*e* and 2*c* excitation is retarded by the angular displacement between line 83 and a parallel line drawn through points 2*c*–2*e*. Finally, the excitation of columns 2*f* and 2*b* are retarded with respect to line 83. This allows the energy propagating away from line 83 in the direction of arrow 82 to "catch-up" with the energy going in the same direction from the other elements 2*b*–2*f*.

Figure 2D:
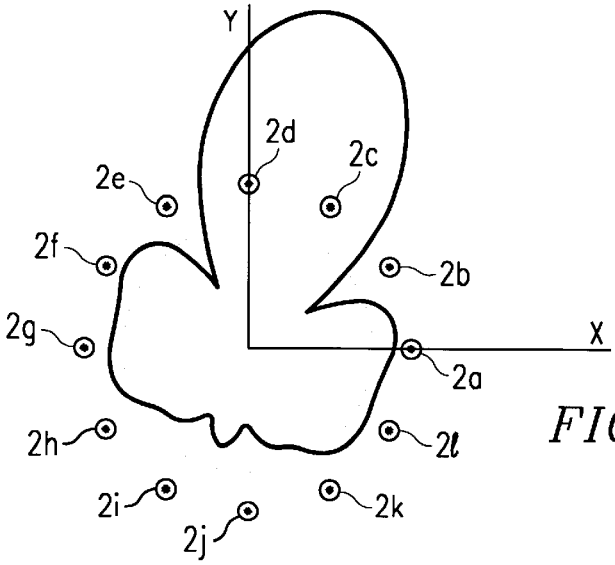

Thus far we have described how a wave front can be synthesized in the "first-degree" to form an antenna beam as shown in FIG. 2D. However, a more sophisticated synthesis takes into account the effect of the divergence factors resulting from the outer column image sources and the presence of the curved conic surface effecting these image sources.

$$D = \text{divergence factor}$$

$$D = \frac{\text{reflected field curved surface}}{\text{reflected field flat surface}}$$

Figure 11A:
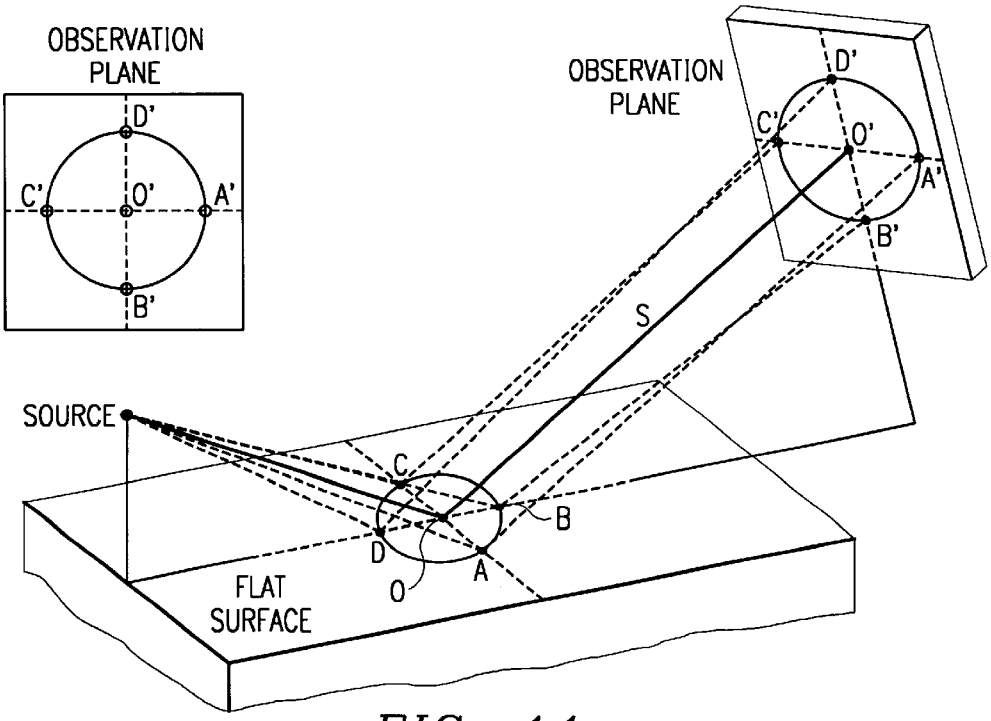
FIGS. 11A and 11B are diagrams illustrating reflections from a flat and a spherical surface, respectively.
Figure 11B:
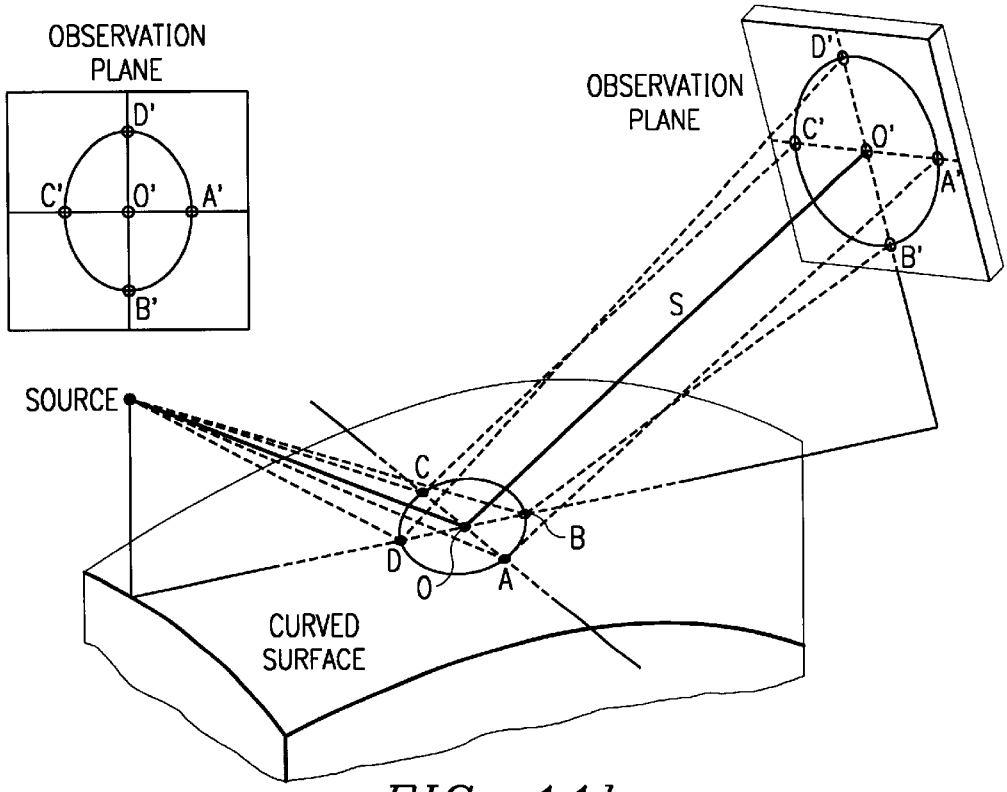
Figure 11C:
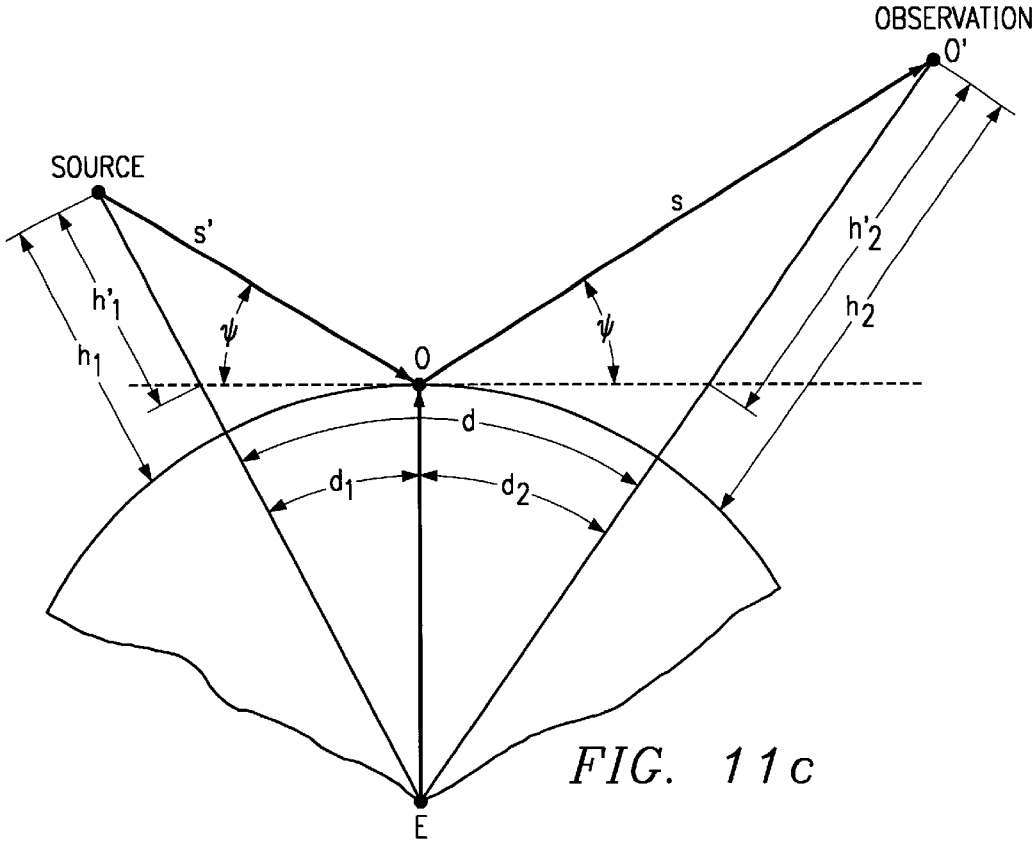
FIG. 11C is a diagram illustrating the geometry for reflections from a spherical surface.

The formula for D can be derived using purely geometrical considerations. It is accomplished by comparing the ray energy density in a small cone reflected from a sphere near the principal point of reflection with the energy density the rays (within the same cone) would have if they were reflected from a surface. Based on the geometrical optics energy conservation law for a bundle of rays within a cone, the reflected rays within the cone will subtend a circle on a perpendicular surface for reflections from a flat surface, as shown in FIG. 11A. However according to the geometry of FIG. 11B, it will subtend an ellipse for a spherical reflecting surface. Therefore the divergence factor can also be defined as $$D = \frac{E_s}{E_f} = \left[\frac{\text{area contained in circle}}{\text{area contained in ellipse}}\right]^{1/2}$$

where $E_s$=reflected field from spherical surface $E_f$=reflected field from flat surface Using the geometry of FIG. 1 iC and assuming that the divergence of rays in the azimuthal surface (glance vertical to the page) is negligible, the divergence factor can be written as $$D \cong \left[1 + 2 * \frac{s's}{ad * \tan\psi}\right]^{-1/2}$$

where Ψ is the grazing angle. Thus the divergence factor of the above takes into account energy spreading primarily in the elevation surface. When d /«, then $$s' \cong \frac{h_{1'}}{\sin\psi}$$

$$\tan\psi \cong \frac{h_{1'}}{d_1}$$

$$s \cong \frac{h_{2'}}{\sin\psi}$$

$$\tan\psi \cong \frac{h_{2'}}{d_2}$$

For low grazing angles (Ψ small), sin Ψ=tan Ψ, $$D \cong \left[1 + 2 * \frac{h_{1'} * h_{2'}}{a * d * \tan^3\psi}\right]^{-1/2}$$

$$\cong \left[1 + 2 * \frac{d_1^2 * d_2}{a * d * h_{1'}}\right]^{-1/2}$$

$$\cong \left[1 + 2 * \frac{d_1^2 * d_2^2}{a * d * h_{2'}}\right]^{-1/2}$$

$h_1'$=height of the radiating column above the cylinder surface (with respect to the tangent at the point of reflection)

$h_2'$=height of the observation point above the cylinder (with respect to the tangent at the point of reflection)

d=range (along the surface of the cylinder) between the source and the observation point a=radius of the cylinder.

Ψ=reflection angle (with respect to the tangent at the point of reflection).

$d_1$=distance (along the surface of the earth) from the source to the reflection point $d_2$=distance (along the surface of the cylinder) from the observation point to the reflection point The divergence factor can be included in the formulation of the fields radiated by a horizontal dipole, in the presence of the cylinder, $$E_\psi = j\eta \frac{kI_0 l e^{-jkr}}{4 * \pi * r} \sqrt{1 - \sin^2\theta \sin^2\Phi} \quad \left[e^{jkh\cos\theta} + DR_h e^{-jkh\cos\theta}\right]$$

The divergence effect perturbs the value of phase delays and can be estimated by ray tracing, or the use of method of moments programs to effect the best value of delay based on what first side lobe level is desired as well as what target beam width is required by the designer.

The effect of the divergence is to produce a tapered aperture distribution as opposed to a rectangular aperture distribution when all columns are driven at unity and in phase, as in the case of a linear phased array system working in a broadside mode. As the radius of the cylinder increases, the value of the divergence factor increases to the limit where the cylinder surface starts to converge into a flat surface. So, as the divergence factor decreases, the first side lobe level relationship decreases. As the divergence factor increases, so does the first side lobe level relationship. The beneficial effect of the divergence factor is typically demi-nimus when the radius grows beyond 3λ/2.

Since the radiator columns are identical around the circumference of the conic (cylinder in this example), the beams are identical to each other and only differ in the fact that the formed beams point in different azimuthal directions. Accordingly, adjacent beams having a different azimuthal orientation may be generated by the antenna systems with the absence of scan loss, i.e., the amplitude of each adjacent beam is the same independent of azimuthal direction, which is not the case with a planar array. Preferably, each of the beams are illuminated by exciting a designated input port of a feed network (beam-forming or phasing network) assigned to that particular beam/direction, as is discussed in further detail below with respect to a preferred embodiment feed network.

Figure 5A:
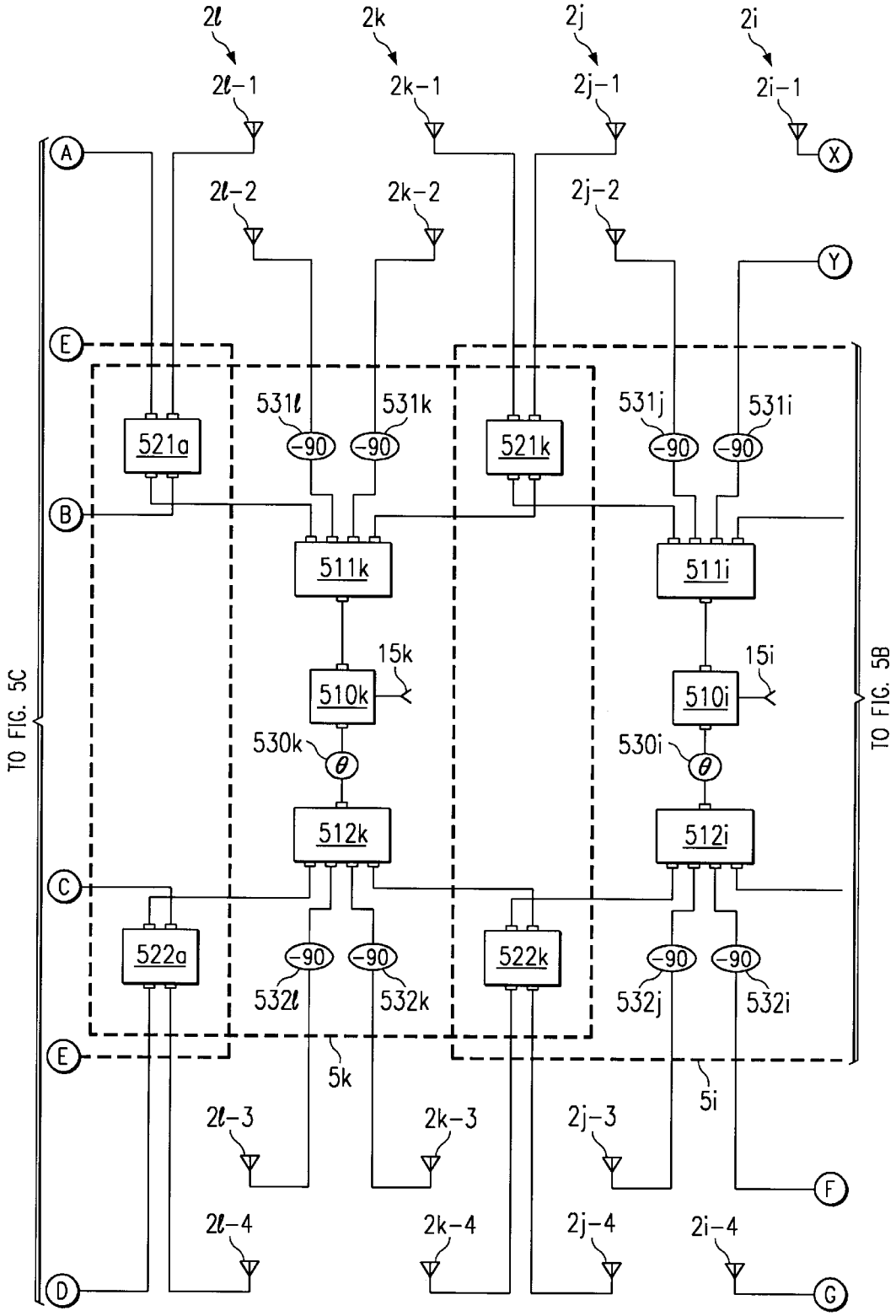
FIGS. 5A–5C and 7A–7C show preferred embodiment twelve-column (a–l) coherent feed systems for the antenna system shown in FIG. 3.
Figure 5B:
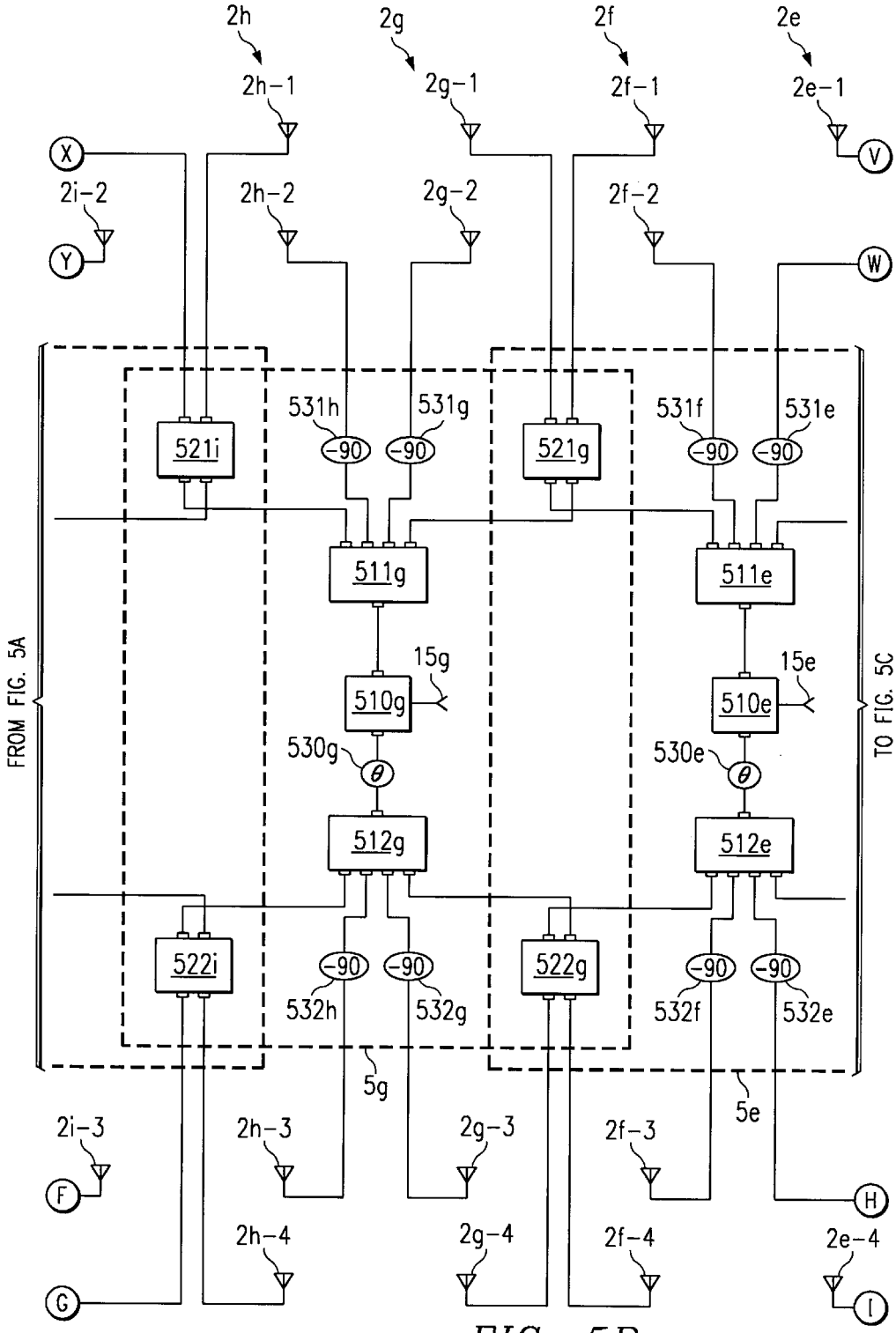
Figure 5C:
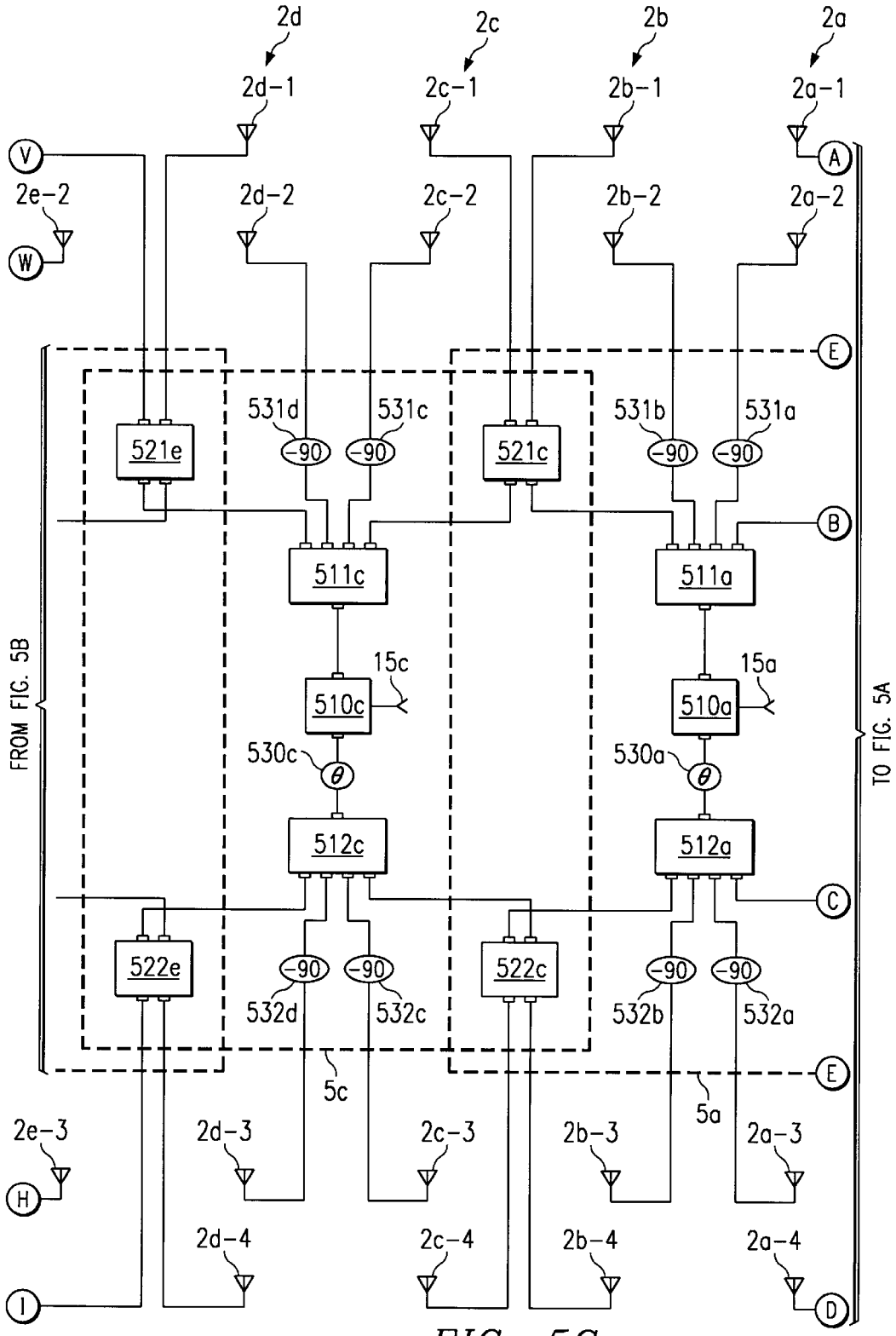
Figure 6:
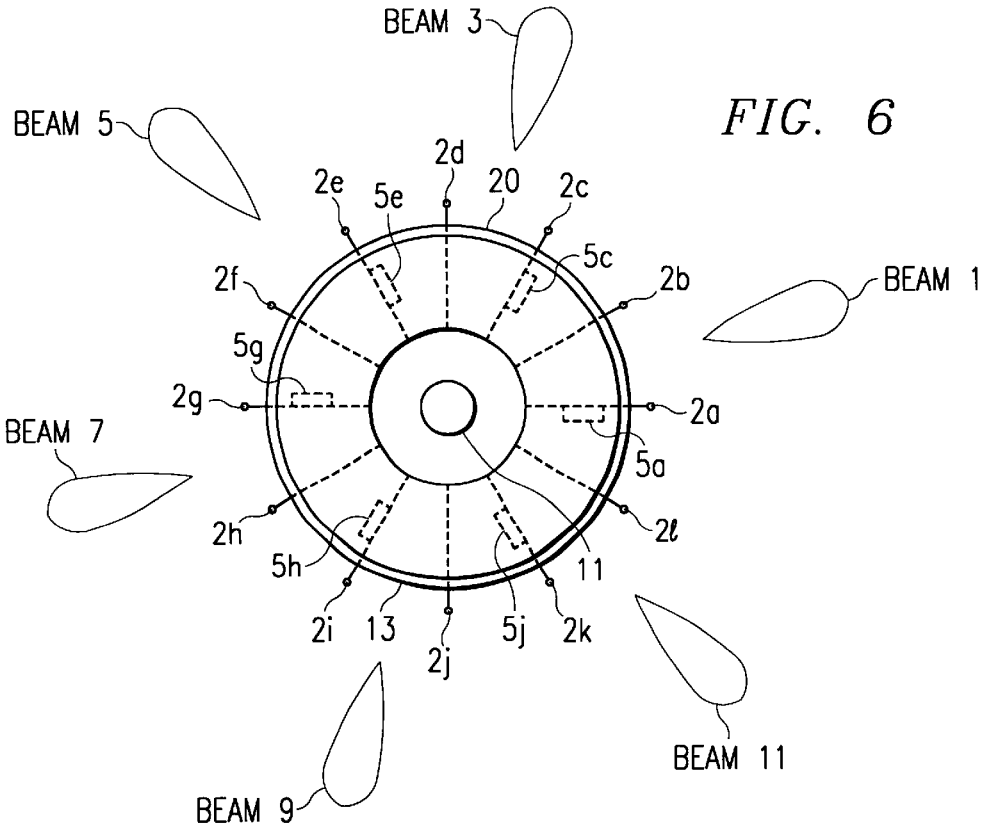
FIGS. 6 and 8 illustrate the antenna beams formed by the feed systems of FIGS. 5 and 7 respectively.

FIGS. 5A–5C show a preferred embodiment feed network 500 for a twelve radiating column system as shown in FIG. 1. This feed network is adapted to include a four-column excitation pattern to form six non-overlapping antenna beams as shown in FIG. 6. It shall be appreciated that the size of the antenna beams (azimuthal beam width as defined by the −3 dB points) formed is a function not only of the number of antenna columns simulcasting a signal for spatial combining, but also by there positioning with respect to each other, i.e., inter column spacing, and their positioning with respect to the ground plane surface.

In a preferred embodiment the radius of the ground surface cylinder is selected to be approximately the distance of one wavelength (λ) and the antenna elements are disposed in the range of ⅛ to ½ wavelength (λ) from this surface and equally spaced from one another. In a most preferred embodiment, where cellular communication frequencies in the 800 MHZ range or personal communication services (PCS) frequencies in the 1.9 GHZ range are communicated, the radius of the ground surface is selected to be λ and dipole elements of the antenna columns are disposed ¼ λ above the ground surface to provide antenna beams having a width of approximately 30 degrees. Of course, other configurations of the components of antenna 10 may be utilized according to the present invention, including different radii of the ground plane, placement of antenna elements with respect to each other and/or the ground plane, number of antenna elements and/or antenna columns, and the like, in order to provide antenna beams having desired characteristics.

Determining the above relationships between the components of antenna system 10 may be accomplished according to the following example. In a preferred embodiment, the columns are to be separated from each other by $$\leq \frac{4}{5}\lambda.$$

Since there are twelve such columns in the preferred embodiment, the circumference of the column radiators is defined, for example use $$\frac{\lambda}{2}.$$

$$\text{Circumference} = 2 * \pi * \text{radius} = 12 * \left(\frac{1}{2}\right) * \lambda$$

$$\text{radius} = \frac{(3 * \lambda)}{\pi}$$

Now, choosing to normalize the value of λ to equal a value of one, the following numerical value may be used:

$$\frac{(3 * \lambda)}{\pi} = 0.9549$$

The above value establishes how far the column radiators should be from the center of the cylinder in the X-Y surface. Since dipoles are being used in this example, and choosing to have them at λ/4 above the ground surface, the radius of where the ground surface is in relation to the center of the system is established.

$$\frac{(3 * \lambda)}{\pi} - \frac{\lambda}{4} = 0.7049 \quad \text{where} \quad \lambda = 1$$

With the above parameters established we can proceed with the description of operation of the antenna system in providing desired antenna beams.

Each antenna beam formed by feed network 500 is associated with a respective beam former connector, connectors 15*a*, 15*c*, 15*e*, 15*g*, 15*i*, and 15*k*, and respective beam former circuitry, beam formers 5*a*, 5*c*, 5*e*, 5*g*, 5*i*, and 5*k*. For example, in the case of a transmitter (TX), the energy of a signal to be radiated in particular beams enters at one or more of the coax connectors 15*a* through 15*k* to be divided and presented with a proper phase relationship to ones of the antenna columns to radiate the signal within selected antenna beams. In the case of a receiver (RX), the energy of signals received at the antenna columns are combined with a phase relationship to null signals sourced outside of selected antenna beams and to present these antenna beam signals at coax connectors 15*a* through 15*k*. It should be clear from the foregoing discussion that the feed network of FIGS. 5A–5C can be used in either direction and, in fact, the same circuit is used in a preferred embodiment for the transmit and receive antennas of the system in order to define substantially co-extensive antenna beams in both the forward and reverse links.

Elements in FIGS. 5A–5C labeled 510*a* through 510*k*, 511*a* through 511*k*, and 512*a*through 512*k*, are called "Wilkinson combiners". This is an in-phase power splitter or combiner, such that a signal input at a splitter input, such as 15*a* of 510*a*, is equally split in power for output at the splitter outputs or a signal input at the combiner inputs, such as those of 510*a* coupled to 511*a* and 512*a*, are combined to provide a summed signal at the combiner output, such as 15*a* of 510*a*. Energy coming out of these splitter elements is split but in phase. Each of the elements 510*a* through 510*k* have two splitter outputs and are, therefore, 2-way splitter/combiners. In contrast, each of elements 511*a* through 511*k* and 512*a* through 512*k* have four splitter outputs and are, therefore, Sway splitter/combiners.

Elements 521*a* through 521*k* and 522*a* through 522*k* have two inputs and two outputs. One input is called "in", or input, and the adjacent one is called "ISO", or isolation. On the output side there is a terminal that is associated with a zero degree phase shift and one that is associated with a −90 degree phase shift for each input. For example, when energy comes to the "in" port, the port directly above this input provides an output signal with a zero degree phase shift relative to the signal input at the "in" port. However, the port diagonally above this input provides an output signal with a −90 degree phase shift relative to the signal input at the "in" port. Similarly, when energy comes to the isolation port, the port directly above this input provides an output signal with a zero degree phase shift relative to the signal input at the "ISO" port, and the port diagonally above this input provides an output signal with a −90 degree phase shift. Accordingly, in addition to providing power splitting or combining, a phase shift is introduced as between the output ports. Accordingly, these elements are called hybrid splitters/combiners.

Elements 530*a* through 530*k*, 531*a* through 531*l*, and 532*a* through 5321 provide selected amounts of phase shifting to signals passed there through. These phase shifters may be comprised of any number of devices suitable for providing a desired phase shift, such as a surface acoustic wave (SAW) device, differing lengths of coax cable, in-phase and quadrature (I/Q) signal combiners, or the like. The amounts of phase shift introduced by ones of these elements may be fixed at a predetermined amount determined to provide desired results. Additionally, or alternatively, the amounts of phase shift introduced by ones of these elements may be adjustable to allow for dynamic adjustment of the phase shifting. For example, in a preferred embodiment of the present invention, at least phase shifters 520*a* through 530*k* are adapted to be adjustable in order to provide for dynamically adjusting electrical down-tilt of an associated antenna beam, as will be discussed in more detail below.

For each connector, such as connector 15*a*, the energy is equally divided by Wilkinson splitter 510. The energy is split evenly and arrives at Wilkinson splitters 511 and 512 where the energy is again divided. A portion of the energy split by splitters 511 and 512 goes to column center antenna elements of columns, such as columns 2*a* and 2*b* in the example of a signal provided to connector 15*a*. However, a portion of that energy again is power divided by hybrid combiners 521, 521, 522, and 522, coming out as 0° and −90° from hybrid combiners 521 and 522 and as −90° and 0° from hybrid combiners 521 and 522. This energy then illuminates or excites column end antenna elements of the columns forming the beam, such as columns 2*a*, 2*b*, 2*c*, and 21 in the example of a signal provided to connector 15*a*. The object is that energy enters a connector, such as connector 15*a*, and is supplied to a select number of antenna columns, in the preferred embodiment four antenna columns, such that a predetermined phase progression is provided to form a desired antenna beam. In the illustrated embodiment, reading across from left to right, the phase of the energy is at 0° at antenna 2*c*, −90° at antenna 2*b*, −90° at antenna 2*a*, and 0° at antenna 21. This topology creates a beam defined by four antennas which are illuminated in this manner. The relationship between the separate dipoles (2*a*-1, 2*a*-2, etc.) of each column will be discussed in detail hereinafter.

Looking at the power flow through the feed system of the preferred embodiment, connecting a source to a Wilkinson, such as 510*a*, with a 1 watt source provides for a ½ watt (1 watt power divided among two outputs) in phase output at each output port. Now looking at this signal as it is again applied to a Wilkinson, such as 511*a*, this now ½ watt source provides for a ⅛ watt (½ watt power divided among four outputs) in phase output at each output port (it should be appreciated that, although only the upper portion of beam former 5*a* is described, the lower half is symmetrical and therefore the power flow there through is also as described). Now with elements 521*a* and 521*c*, if only the signals from splitter 511*a* are coupled thereto, the hybrid splitter will again power divide the signal to provide 1/16 watt (⅛ watt power divided among two outputs). However, the outputs of the hybrid will not be in phase, but rather 90 degrees out of phase, in the case of 90 degree hybrids.

As shown in FIGS. 5A–5C (perhaps more easily appreciated from a review of FIGS. 9 and 10), the signals further power divided by hybrid splitters 521*a* and 521*c*, and therefore having less amplitude then the outputs of splitter 511*a*, are coupled to "edge"antenna elements. Specifically, top edge element 2*b*-1 and side edge element 2*c*-2 are coupled to hybrid splitter 521*c*. Likewise, top edge element 2*a*-1 and side edge element 2*l*-2 are coupled to hybrid splitter 521*a*. Accordingly, feed network 500 of the preferred embodiment provides aperture tapering in both the horizontal and vertical planes to thereby provide improved side lobe level control.

The distribution of power as among the outputs of the hybrid combiner may be shifted by altering the relative phase of the signals input to each of the hybrid inputs, i.e., quadrature combining. Such a result may be utilized, if desired, in aperture tapering, such as to provide the elements of the array excited with a particular signal with weighting for grating lobe and side lobe control. However, undesired or arbitrary redistribution of power by these hybrid combiners due to out of phase signals provided to the inputs of the hybrid combiners by the preferred embodiment of the present invention is not an issue as if a same signal is to be radiated in adjacent beams, and therefore provided to multiple inputs of a hybrid combiner, the structure of the feed network is such that these signals will be substantially in phase.

It should be appreciated that the preferred embodiment feed network 500 does not utilize power combining of signals as provided to the antenna columns, i.e., no antenna element is coupled to multiple outputs of Wilkinson splitter 511*a* or of hybrid combiners 512*a* or 521*c*. This is desirable because non-coherent combining results in a power loss. For example, when sources are connected to each input of a Wilkinson combiner that are in phase and at a same frequency, such as a ½ watt source at each input, it will result in 1 watt being output. This is called coherent combining. However, where the two sources are not coherent, such as one is at 900 MHZ ½ watt and one is at 800 MHZ ½ watt, each being connected to a respective input of a Wilkinson combiner, the output signal is not 1 watt. What happens is a 3 dB is lost by each source. This occurs because the combiner acts as a resistor across the two output ports. When the element senses that there is non-coherent (different frequencies) combining, even though they are each at ½ watt, what comes out is a ¼ watt 800 MHZ source, and a ¼ watt 900 MHZ source. They are not combined at all. They are just separate entities coming out of the input port to the antenna When the system has separate transmitters on 15*c* and 15*d*, one could be at 900 MHZ and one at 800 MHZ, left alone they would create two separate beams. These two beams share antenna 2*d* which is fine, but a 3 dB tax has been paid.

Accordingly, the preferred embodiment feed network 500 is adapted to eliminate non-coherent combining and the attendant loss and noise figure deficiencies of such a technique. However, it should be appreciated that the avoidance of non-coherent combining by the preferred embodiment feed network 500 results in the formation of beams phase centered between every other antenna column, as shown in FIG. 6, rather than between every antenna column such as provided systems having non-coherent combining, such as shown in systems of the above referenced patent application entitled CONICAL OMNI-DIRECTIONAL COVERAGE MULTIBEAM ANTENNA. Depending on the desired beam width and the coverage of a service area surrounding the placement of antenna 10, it may be desirable to supplement this antenna beam pattern.

Figure 3:
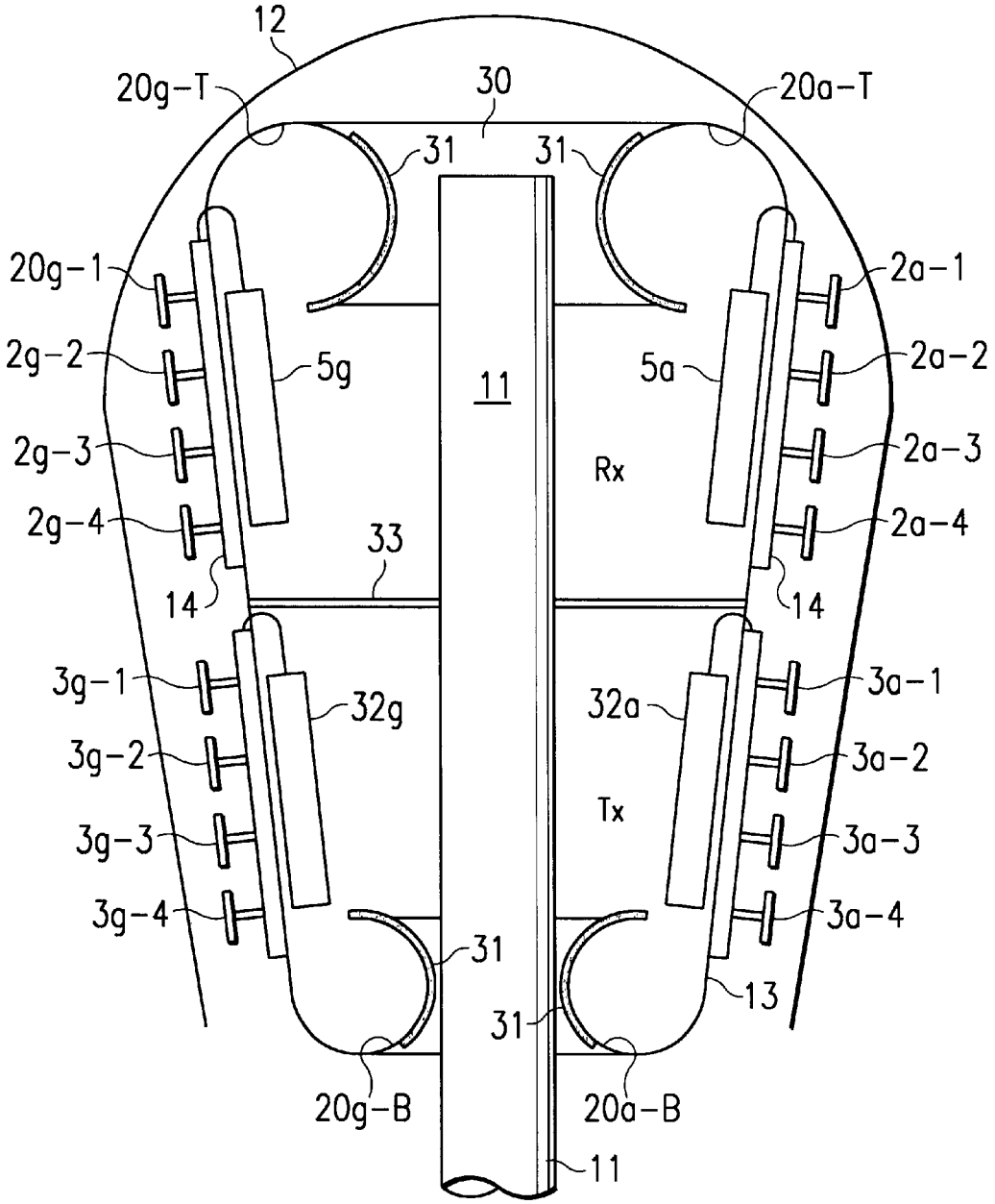
FIG. 3 is an axial cross-sectional view of the compartmentalized version of the inventive antenna, showing separate antenna sections.
Figure 8:
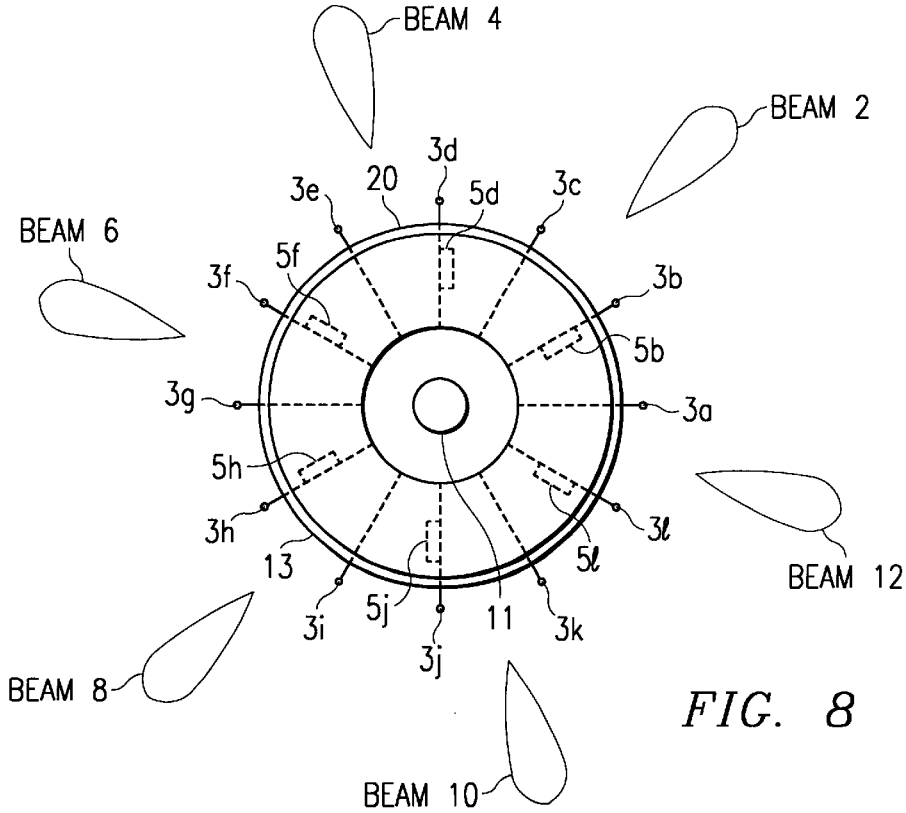

FIG. 3 shows that the internal compartment 30 of the cylinder can include partition 33 to create a separate antenna arrays such as may be used for a transmit and receive system or to provide additional beams for additional coverage in a service area. Accordingly, each portion of this alternative embodiment cylinder may be adapted to provide antenna beams which are oriented to complement one another in covering an area to be serviced. For example, the upper portion of the system could include feed network 500 of FIG. 5 to provide antenna beams as shown in FIG. 6, while the lower portion of the system includes feed network 700 of FIG. 7 to provide antenna beams as shown in FIG. 8. It should be appreciated that the antenna beams of FIGS. 6 and 8 are substantially the same, although their orientation is such that together they provide twelve contiguous substantially non-overlapping antenna beams providing 360 degrees of service area coverage, i.e., beams 1, 3, 5, 7, 9, and 11 of FIG. 6 interleave with beams 2, 4, 6, 8, 10, and 12 of FIG. 8 when the antennas are disposed as shown in FIG. 3.

Figure 7A:
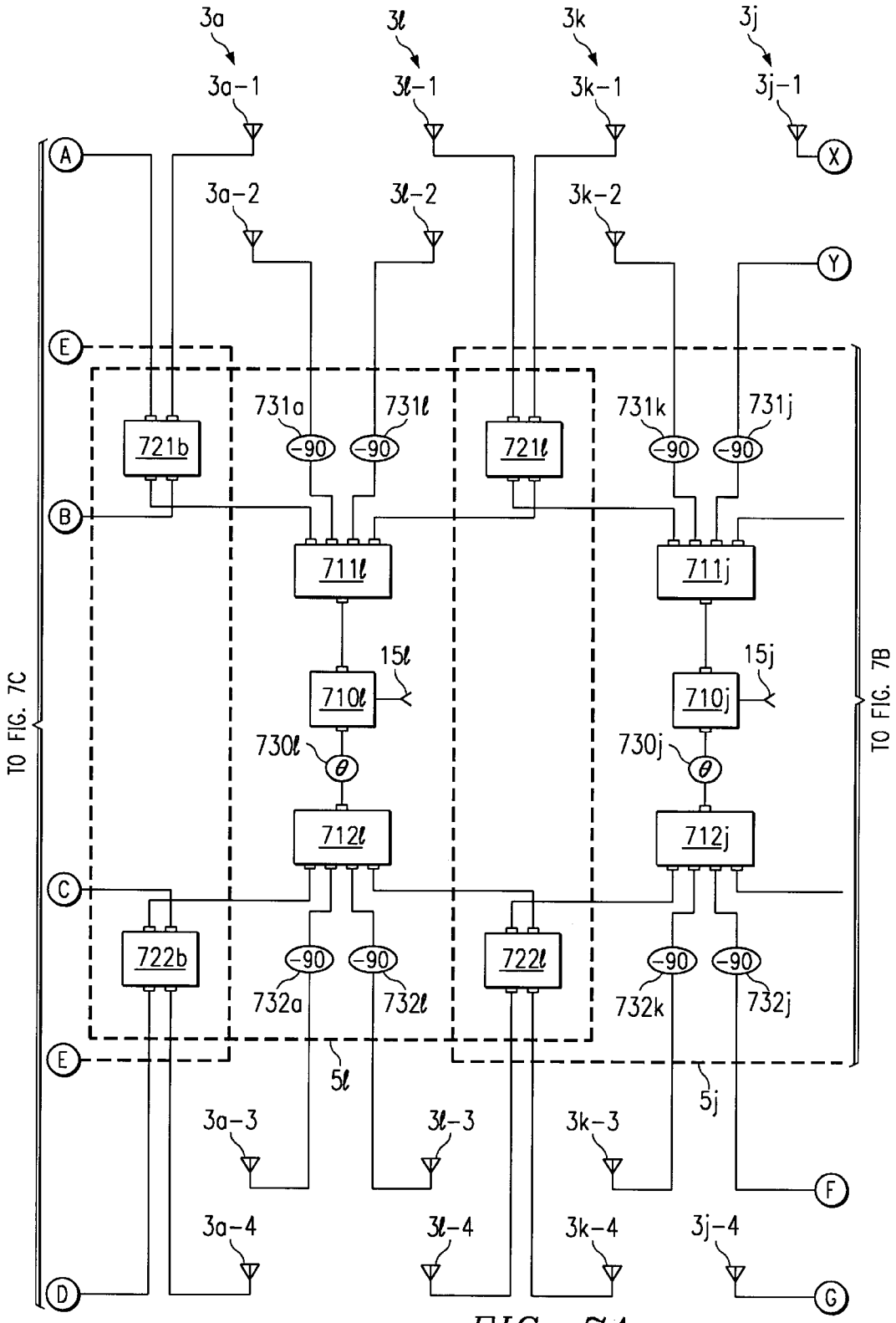
Figure 7B:
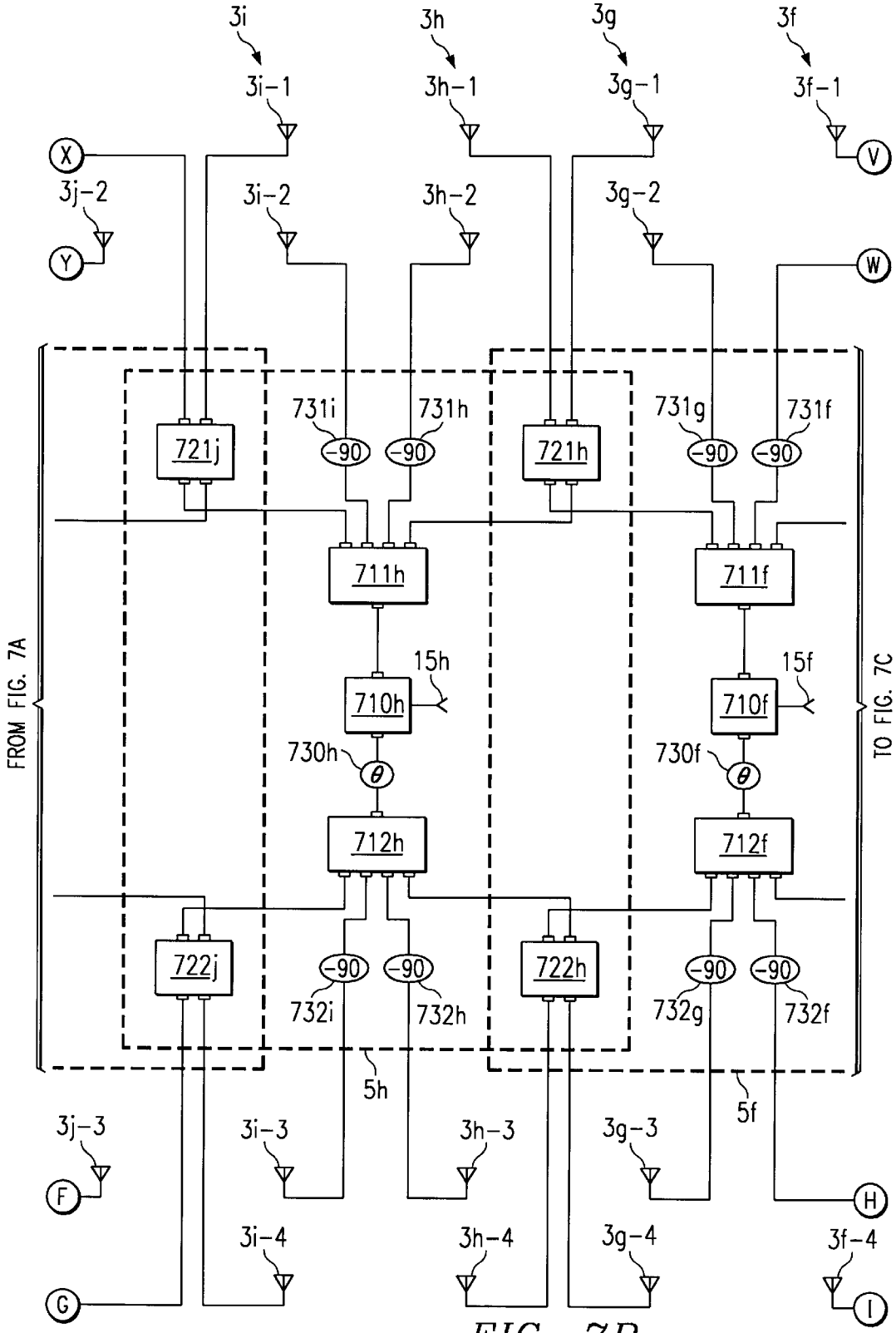
Figure 7C:
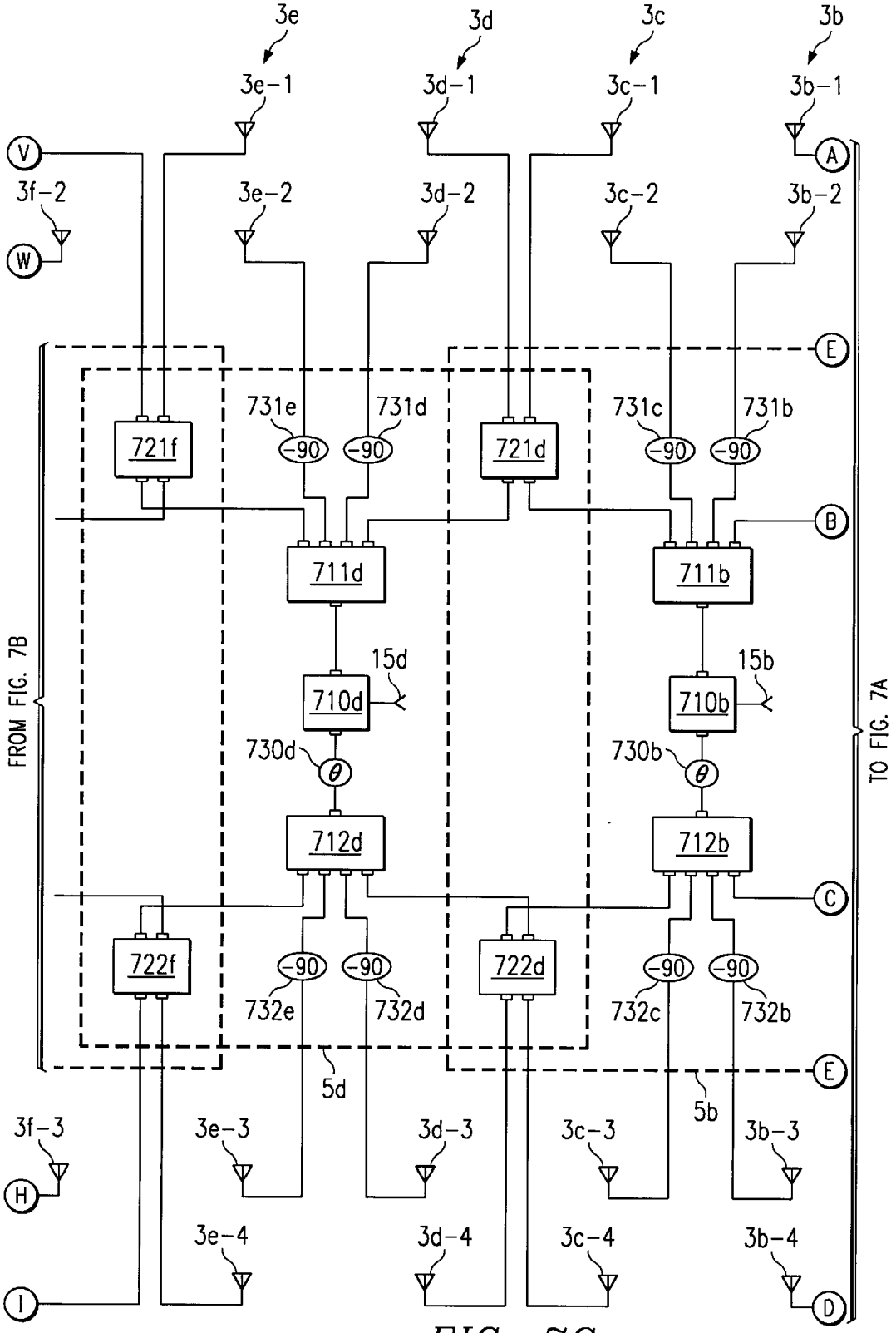

It should be appreciated that the preferred embodiment of feed network 700 of FIG. 7 is substantially the same as that of feed network 500 of FIG. 5, being adapted to provide azimuthal offset of the antenna beams as described above. Accordingly, elements in FIG. 7 labeled 710*b* through 710*l*, 711*b* through 711*l*, and 712*b* through 712*l*, Wilkinson combiners, and elements 721*b* through 721*l* and 722*b* through 722*l* are hybrid combiners, and elements 730*b* through 730*l*, 731*a* through 731*l*, and 732*a* through 732*l* provide selected amounts of phase shifting to signals passed there through.

Additionally, or alternatively, a portion of the system of FIG. 3 could be receive only, while another portion is transmit only. This would allow the elimination of costly and complicated duplexer systems that are used when receivers and transmitter systems share the same antenna system. Moreover, two such systems (cylinders in this case) could also be separated in space to effect space-diversity, horizontally or vertically.

The first side lobes and others can be reduced by the presence of the upper and lower elevation side lobe suppressor torus, as shown in FIG. 3 as elements 20*a*-T(TOP), 20*a*-B(BOT), 20*g*-T and 20*g*-B. The sheet current created as a by-product of the normal function of electromagnetic radiation, can have undesirable side effects, especially if this current sheet happens onto a surface discontinuity such as an edge. The discontinuity then will act as a launch mechanism and convert the sheet current back into propagating radiation. The edge, in the case of a cylinder, acts like two radiating hoop structures, (one on top and one at the bottom of the cylinder) that superimpose their respective radiation patterns onto the desired column radiator pattern. Thus, by having the sheet current follow the curve of the torus, ideally having a radius $>\lambda/4$ and when an absorbing material 31 is present to turn this current into heat, the side lobes in the elevation surface can be controlled. Four such suppressors could be used, one in each chamber, for an RX and TX antenna system, if desired.

In addition to avoiding non-coherent combining at the array elements, and thus the 3 dB loss in gain and noise figure attendant therewith, the preferred embodiment feed network of the present invention also provides aperture tapering useful in the further suppression of side lobes. Directing attention to FIG. 9, a portion of cylinder array antenna system 10 associated with beam former 5*a* is shown. In this view, it can readily be seen that beam former 5*a* of the feed network of FIG. 5 couples a signal of port 15*a* to only twelve of the sixteen antenna elements of antenna columns 2*a*, 2*b*, 2*c*, and 2*l*. Specifically, the corner antenna elements in the outer two antenna columns, antenna elements 2*c*-1, 2*c*-4, 21-1, and 2*l*-4, are not coupled to beam former 5*a*. Accordingly, as seen in the broadside view of this portion of the antenna in FIG. 10, antenna elements 2*a*-1, 2*a*-2, 2*a*-3, 2*a*-4, 2*b*-1, 2*b*-2, 2*b*-3, 2*b*-b, 2*c*-2, 2*c*-3, 2*l*-2, and 2*l*-3 are coupled to an antenna beam signal of port 15*a*. Coupling of these selected elements, as opposed to all sixteen elements, establishes a tapered aperture which promotes improved side lobe level behavior. However, it should be appreciated that the preferred embodiment feed network is adapted to utilize these corner antenna elements when forming other antenna beams. Accordingly, the preferred embodiment feed network provides for tapered aperture distribution without adversely affecting the ability to form beams using other beam forms of feed network 500.

The fact that the array elements are disposed in a cylindrical or curved orientation of a specific radius, suggests that the two inner columns be electrically delayed in phase by an amount suitable to allow the outer column wave front to "catch-up" with the wave front of the two outer columns in order to create a planar wave front suitable for forming a desired antenna beam. In the preferred embodiment feed network, this wave front delay is provided for antenna elements 2*a*-2, 2*b*-2, 2*a*-3, and 2*b*-3 by the phase shift of hybrid combiners 521*a*, 521*c*, 522*a*, and 522*c* respectively. Whereas the wave front delay is provided for antenna elements 2*a*-1, 2*b*-1, 2*a*-4, and 2*b*-4 by phase shifters 531*a*, 531*b*, 532*a* respectively.

It should be appreciated that, depending on the radius of the curved orientation of the antenna elements, different amounts of phase delay may be desired at ones of the antenna elements. Accordingly, phase shifters in addition to or in the alternative to the hybrid combiners may be utilized in alternative embodiments to provide a desired amount of phase delay. Additionally, or alternatively, hybrid combiners introducing amounts of phase delay other than the 90 degree delay of the preferred embodiment hybrid combiners may be used. Likewise, amounts of phase delay other than the 90 degree phase delay of the preferred embodiment phase shifters 531*a* through 531*l* and 532*a* through 532*l* may be used.

Figure 9:
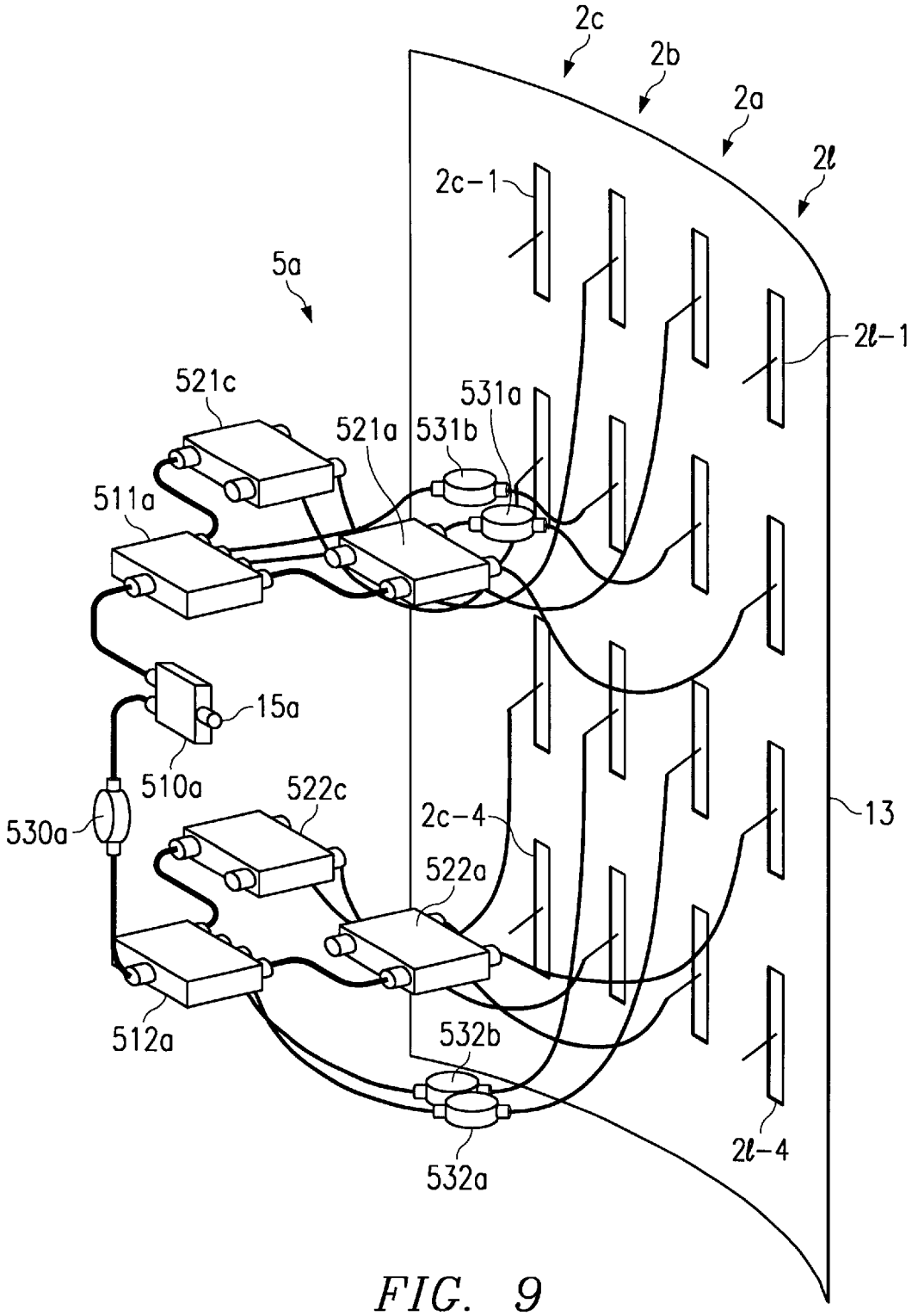
FIG. 9 shows an elevational view of a portion of the antenna array of FIG. 3 coupled to a beam former of the feed system of FIG. 5.
Figure 10:
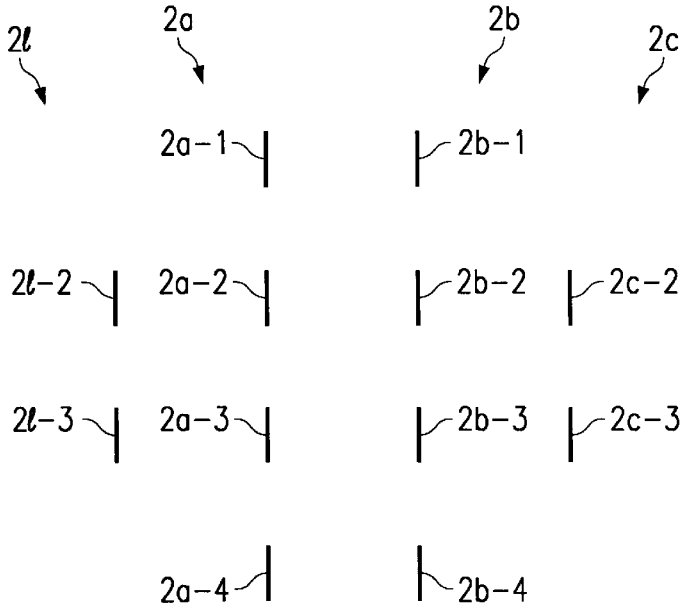
FIG. 10 shows a broadside view of the energized antenna elements of FIG. 9.

Referring still to FIGS. 9 and 10, it can be appreciated that beam former 5*a* of the preferred embodiment feed network 500 divides the antenna elements into two groups of two rows of antenna elements each. Accordingly, an upper "phase-center" is formed from antenna elements 2*a*-1, 2*a*-2, 2*b*-1, 2*b*-2, 2*c*-2, and 2*l*-2 and a lower phase-center is formed from antenna elements 2*a*-3, 2*a*-4, 2*b*-3, 2*b*-4, 2*c*-3, and 2*l*-3. In the preferred embodiment these two phase-centers are utilized to provide elevation steering or electrical down-tilt of the antenna beam.

Accordingly, phase shifter 530*a* is provided to introduce a relative phase delay in the signal associated with antenna elements of the lower phase-center to provide a desired amount of electrical down-tilt. The phase shifters utilized for providing electrical down-tilt may be comprised of any number of devices suitable for providing a desired phase shift, such as a surface acoustic wave (SAW) device, differing lengths of coax cable, in-phase and quadrature (I/Q) signal combiners, or the like. Additionally, these phase shifters may be fixed, such as to provide a constant amount of electrical down-tilt, or adjustable, such as to allow for dynamic changing of the electrical down-tilt.

It should be appreciated that the least amount of degradation of the scanned beam will be experienced where a phase-center is associated with a single row of antenna elements. Accordingly, in addition to providing phase delays associated with forming a planar wave front, phase shifters

531*a*, 531*b*, 532*a*, and 532*b* may be utilized to provide an amount of phase differential such that a constant phase progression is seen between the elements of antenna columns 2*a* and 2*b*. For example, where phase shifter 530*a* introduces a phase delay of $\Delta\phi$ between the signals of the upper phase-center and the lower phase-center, phase shifters 531 a and 53 lb may be adjusted to phase advance the signal at antenna elements 2*a*-1 and 2*b*-1 by $\Delta\phi$, i.e., the −90 degree phase shift of phase shifters 531*a* and 531*b* may be $-90° +\Delta\phi$. Similarly, phase shifters 532*a* and 532*b* may be adjusted to phase delay the signal at antenna elements 2*a*-4 and 2*b*-4 by $\Delta\phi$, i.e., the −90 degree phase shift of phase shifters 532*a* and 532*b* may be $-90°-\Delta\phi$. Accordingly, a constant phase progression of $\Delta\phi$(2*a*-1 at $-90° -\Delta\phi$, 2*a*-2 at $-90°$, 2*a*-3 at $-90°\Delta\phi$, and 2*a*-4 at $-90°-\Delta\phi-\Delta\phi$) may be seen down the antenna columns.

Where phase shifter 530*a* is adjustable, the above described phase progression may be accomplished through adapting phase shifters 531*a*, 531*b*, 532*a*, and 532*b* to also be adjustable, such as under control of a common controller. However, in order to provide a less costly and simplified feed network, an alternative embodiment of the present invention utilizes an adjustable phase shifter as phase shifters 510*a* through 510*k* and fixed phase shifters at 531*a* through 531*k* and 532*a* through 532*k*. Accordingly, the antenna elements of a column of the upper phase-center may have no phase progression associated therewith and, likewise, the antenna elements of a column of the lower phase-center may have no phase progression associated therewith. However, it shall be appreciated that a predetermined amount of phase difference may be included between the elements of each column of a phase-center to improve beam quality when steered down. For example, a phase difference between the individual elements of each column phase-center may be selected to optimize the beam at a predetermined down tilt angle. For example, an intra phase-center delay may be selected to optimize the beam at a predetermined down-tilt angle. Where a particular down-tilt angle is expected to predominate, this intra phase-center delay may be selected to cause the summed signal of the elements of the phase-center column to result in that particular down-tilt. Of course, this intra phase-center down-tilt may introduce some undesirable characteristics when the composite beam of the antenna phase-center columns are summed. These undesirable characteristics would increase as the beam is steered further away from the down-tilt angle selected for the intra sub-group delay. Therefore, alternatively, the intra phase-center delay may be selected to be commensurate with some angle between the various down-tilt angles expected to be used. This selection of the intra phase-center delay would minimize the effect of the grating lobe generation at each of the down-tilt angles.

It should be understood that various changes, substitutions and alterations can be made from the preferred embodiment systems and methods provided herein without departing from the spirit and scope of the invention. For example, although FIG. 1 has been discussed with respect to its use as a transmitting structure, it could also be a receiving structure or receiving and transmitting structures could be interposed and could be of different designs. Also, the ground surface could be discontinuous at points around the periphery and the antenna design could be adjusted around the periphery for different transmission or terrain conditions. Additionally, different numbers of antenna columns, antenna elements per column, and/or types of antenna elements may be utilized according to the present invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna feed system adapted to provide directional antenna beams from an antenna array having a plurality of antenna elements arranged in columns which are disposed along a curve, said system comprising:

a plurality of beam former circuits, each said beam former circuit adapted to provide a predetermined phase progression with respect to signals associated with selected ones of said columns, said predetermined phase progression being at least in part a function of said curve, each said beam former circuit also adapted to provide aperture tapering by coupling signals of outer ones of said selected ones of said columns differently than inner ones of said selected ones of said columns.

2. The system of claim 1, wherein each beam former circuit comprises:

a first phase-center of antenna elements of said columns having said predetermined phase progression with respect to signals associated with said selected ones of said columns; and a second phase-center of antenna elements of said columns having said predetermined phase progression with respect to signals associated with said selected ones of said columns.

3. The system of claim 2, wherein each beam former circuit further comprises:

a phase shifter adapted to introduce a relative phase difference between signals of said first phase-center and said second phase-center to thereby provide elevational beam steering for an antenna beam of a first beam former circuit independent of an antenna beam of a second beam former circuit.

4. The system of claim 1, further comprising:

a plurality of antenna beam ports adapted to couple antenna beam signals between said antenna feed system and circuitry external to said antenna feed system, wherein at least one antenna beam port of said plurality is associated with each beam former circuit; and a plurality of antenna column ports adapted to couple said antenna feed system to said plurality of antenna elements, wherein ones of said antenna column ports are associated with multiple ones of said beam former circuits.

5. The system of claim 1, wherein said different coupling to outer ones of said selected ones of said columns provides said signals to inner antenna elements of said outer columns.

6. The system of claim 1, wherein at least one column of said columns is coupled to at least two beam former circuits of said plurality of beam former circuits, and wherein said column aperture tapering provided by a first beam former circuit of said at least two beam former circuits is independent of beam forming by a second beam former circuit of said at least two beam former circuits.

7. The system of claim 1, wherein said beam former circuits of said plurality of beam former circuits are coupled to said selected ones of said columns without introducing non-coherent combining at the columns.

8. The system of claim 7, wherein said non-coherent combining is provided by utilizing hybrid combiners of said beam forming circuits to couple said beam forming circuits.

9. The system of claim 1, wherein a number of columns of said selected ones of said columns each beam former circuit provides a predetermined phase progress to is four.

10. The system of claim 9, wherein each said beam former circuit comprises:

a first four way splitter/combiner having an antenna beam signal port and four splitter/combiner ports associated therewith, wherein a first splitter/combiner port of said four splitter/combiner ports is coupled to an antenna element of a first column of said four columns, and wherein a second splitter/combiner port of said four splitter/combiner ports is coupled to an antenna element of a second column of said four columns;

a first hybrid combiner coupled to a third splitter/combiner port of said four splitter/combiner ports and antenna elements of said first column and a third column of said four columns; and a second hybrid combiner coupled to a fourth splitter/combiner port of said four splitter/combiner ports and antenna elements of said second column and a fourth column of said four columns.

11. The system of claim 10, wherein each said beam former circuit further comprises:

a two way splitter/combiner having an antenna beam signal port and two splitter/combiner ports, wherein a first splitter/combiner port of said two splitter/combiner ports is coupled to the antenna beam signal port of said first four way splitter/combiner;

a second four way splitter/combiner having an antenna beam signal port and four splitter/combiner ports associated therewith, wherein a second splitter/combiner port of said two splitter/combiner ports is coupled to the antenna beam signal port of said second four way splitter/combiner, and wherein a first splitter/combiner port of said four splitter/combiner ports of said second four way splitter/combiner is coupled to an antenna element of said first column of said four columns, and wherein a second splitter/combiner port of said four splitter/combiner ports of said second four way splitter/combiner is coupled to an antenna element of said second column of said four columns;

a third hybrid combiner coupled to a third splitter/combiner port of said four splitter/combiner ports of said second four way splitter/combiner and antenna elements of said first column and said third column of said four columns; and a fourth hybrid combiner coupled to a fourth splitter/combiner port of said four splitter/combiner ports of said second four way splitter/combiner and antenna elements of said second column and said fourth column of said four columns.

12. The system of claim 11, wherein each said beam former circuit further comprises:

a first phase shifter coupled between said second splitter/combiner port of said two splitter/combiner ports and the antenna beam signal port of said second four way splitter/combiner.

13. The system of claim 12, further comprising:

a controller coupled to said first phase shifter adapted to control a phase shift provided by said first phase shifter to provide elevational beam steering of an antenna beam associated with a first beam former circuit independent of a second beam former circuit.

14. The system of claim 12, wherein each said beam former circuit further comprises:

a second phase shifter coupled between said first splitter/combiner port of said four splitter/combiner ports of said second four way splitter/combiner and said coupled antenna element of said first column of said four columns; and a third phase shifter coupled between said second splitter/combiner port of said four splitter/combiner ports of said second four way splitter/combiner and said coupled antenna element of said second column of said four columns.

15. An antenna feed system adapted to provide antenna beams from an antenna array having a plurality of antenna elements arranged in columns which are disposed along a curve, said system comprising:

a plurality of beam former circuits, each said beam former circuit adapted to provide a predetermined phase progression with respect to signals associated with selected ones of said columns, said predetermined phase progression being at least in part a function of said curve, each said beam former circuit comprising:

a first phase-center of antenna elements of said columns having said predetermined phase progression with respect to signals associated with said selected ones of said columns;

a second phase-center of antenna elements of said columns having said predetermined phase progression with respect to signals associated with said selected ones of said columns; and a phase shifter adapted to introduce a relative phase difference between signals of said first phase-center and said second phase-center to thereby provide elevational beam steering for an antenna beam of a first beam former circuit independent of an antenna beam of a second beam former circuit.

16. The system of claim 15, wherein each beam former circuit comprises:

aperture tapering signal paths coupling signals of outer ones of said selected ones of said columns differently than inner ones of said selected ones of said columns.

17. The system of claim 16, wherein said aperture tapering signal paths are adapted to provide said signals to inner antenna elements of said outer columns to the exclusion of outer antenna elements of said outer columns.

18. The system of claim 16, wherein at least one column of said columns is coupled to at least two beam former circuits of said plurality of beam former circuits.

19. The system of claim 15, wherein said beam former circuits of said plurality of beam former circuits are coupled to said selected ones of said columns without introducing non-coherent combining at the columns.

20. The system of claim 19, wherein said non-coherent combining is provided by utilizing hybrid combiners of said beam forming circuits to couple said beam forming circuits.

21. The system of claim 15, wherein a number of columns of said selected ones of said columns each beam former circuit provides a predetermined phase progress to is four.

22. The system of claim 15, wherein each said beam former circuit comprises:

a first splitter/combiner having an antenna beam signal port and a plurality of splitter/combiner ports associated therewith, wherein a first splitter/combiner port of said plurality of splitter/combiner ports is coupled to an antenna element of a first column of said columns, and wherein a second splitter/combiner port of said plurality of splitter/combiner ports is coupled to an antenna element of a second column of said columns;

a first hybrid combiner coupled to a third splitter/combiner port of said plurality of splitter/combiner ports and antenna elements of said first column and a third column of said columns; and a second hybrid combiner coupled to a fourth splitter/combiner port of said plurality of splitter/combiner ports and antenna elements of said second column and a fourth column of said columns.

23. The system of claim 22, wherein each said beam former circuit further comprises:

a second splitter/combiner having an antenna beam signal port and a plurality of splitter/combiner ports, wherein a first splitter/combiner port of said plurality of splitter/combiner ports of said second splitter/combiner is coupled to the antenna beam signal port of said first splitter/combiner;

a third splitter/combiner having an antenna beam signal port and a plurality of splitter/combiner ports associated therewith, wherein a second splitter/combiner port of said second splitter/combiner is coupled to the antenna beam signal port of said third splitter/combiner, and wherein a first splitter/combiner port of said plurality of splitter/combiner ports of said third splitter/combiner is coupled to an antenna element of said first column of said columns, and wherein a second splitter/combiner port of said plurality of splitter/combiner ports of said third splitter/combiner is coupled to an antenna element of said second column of said columns;

a third hybrid combiner coupled to a third splitter/combiner port of said plurality of splitter/combiner ports of said third splitter/combiner and antenna elements of said first column and said third column of said columns; and a fourth hybrid combiner coupled to a fourth splitter/combiner port of said plurality of splitter/combiner ports of said third splitter/combiner and antenna elements of said second column and said fourth column of said four columns.

24. The system of claim 23, wherein each said beam former circuit further comprises:

a first phase shifter coupled between said second splitter/combiner port of said plurality of splitter/combiner ports and the antenna beam signal port of said third splitter/combiner.

25. The system of claim 24, further comprising:

a controller coupled to said first phase shifter adapted to control a phase shift provided by said first phase shifter to provide elevational beam steering of an antenna beam associated with a first beam former circuit independent of a second beam former circuit.

26. The system of claim 25, wherein each said beam former circuit further comprises:

a second phase shifter coupled between said first splitter/combiner port of said four splitter/combiner ports of said second four way splitter/combiner and said coupled antenna element of said first column of said columns; and a third phase shifter coupled between said second splitter/combiner port of said four splitter/combiner ports of said second four way splitter/combiner and said coupled antenna element of said second column of said columns.

27. A method to provide directional antenna beams from an antenna array having a plurality of antenna elements arranged in columns which are disposed along a curve, said method comprising the steps of:

providing a plurality of antenna beam ports adapted to couple antenna beam signals between said antenna feed system and circuitry external to said antenna feed system;

providing a plurality of antenna column ports adapted to couple said antenna feed system to said plurality of antenna elements; and splitting a signal provided to a first antenna beam port of said plurality of antenna beam ports to thereby provide a first plurality of split antenna beam port signals;

coupling a first split antenna beam port signal of said first plurality of split antenna beam port signals to an antenna element of a first column of said columns;

coupling a second split antenna beam port signal of said first plurality of split antenna beam port signals to an antenna element of a second column of said columns;

coupling a third split antenna beam port signal of said first plurality of split antenna beam port signals to a first hybrid combiner coupled antenna elements of said first column and a third column of said columns; and coupling a fourth split antenna beam port signal of said first plurality of split antenna beam port signals a second hybrid combiner coupled to antenna elements of said second column and a fourth column of said columns.

28. The method of claim 27, further comprising the steps of:

providing a first group of antenna elements associated with a first antenna beam first phase-center, wherein said first plurality of split antenna beam port signals are coupled to said first antenna beam first phase-center;

providing a second group of antenna elements associated with a first antenna beam second phase-center.

29. The method of claim 28, further comprising the steps of:

splitting a signal provided to said first antenna beam port to thereby provide a second plurality of split antenna beam port signals, wherein a first split antenna beam port signal of said second plurality of split antenna beam port signals is the signal split into said first plurality of split antenna beam port signals; and introducing a relative phase difference between said first split antenna beam port signal of said second plurality of split antenna beam port signals and a second split antenna beam port signal of said second plurality of split antenna beam port signals.

30. The method of claim 29, further comprising the step of:

selecting said relative phase difference to provide a desired amount of antenna beam elevation steering of an antenna beam associated with said first antenna beam port.

31. The method of claim 30, wherein said selecting step is independent of selecting any relative phase difference to provide a desired amount of antenna beam elevation steering of an antenna beam associated with any other antenna beam.

32. The method of claim 29, further comprising the steps of:

splitting said second split antenna beam port signal of said second plurality of split antenna beam port signals to thereby provide a third plurality of split antenna beam port signals;

coupling a first split antenna beam port signal of said third plurality of split antenna beam port signals to an antenna element of said first column of said columns;

coupling a second split antenna beam port signal of said third plurality of split antenna beam port signals to an antenna element of said second column of said columns;

coupling a third split antenna beam port signal of said third plurality of split antenna beam port signals to a third hybrid combiner coupled antenna elements of said first column and said third column of said columns; and coupling a fourth split antenna beam port signal of said second plurality of split antenna beam port signals a fourth hybrid combiner coupled to antenna elements of said second column and said fourth column of said columns.

33. An antenna feed system adapted to provide a directional antenna beam from an antenna array having a plurality of antenna elements arranged in columns which are disposed in a circle, said system comprising:

a first beam former circuit adapted to provide a predetermined phase progression with respect to signals associated with selected ones of said columns disposed to provide at least two broadside edge columns, said first beam former circuit also adapted to provide aperture tapering by energizing only inner antenna elements of said broadside edge columns, said first beam former circuit comprising:

a first phase-center of antenna elements of said columns having said predetermined phase progression with respect to signals associated with said selected ones of said columns;

a second phase-center of antenna elements of said columns having said predetermined phase progression with respect to signals associated with said selected ones of said columns; and a phase shifter adapted to introduce a relative phase difference between signals of said first phase-center and said second phase-center to thereby provide elevational beam steering for an antenna beam of said first beam former circuit independent of any other antenna beam.

34. The system of claim 33, wherein said circle of columns includes twelve columns and wherein a number of said selected ones of said columns provided said predetermined phase progression by said first beam former circuit is four.

35. The system of claim 34, wherein said columns include four antenna elements each.

36. The system of claim 35, wherein four antenna elements of said four columns coupled to said first beam former circuit are not coupled to said first beam former circuit.

37. The system of claim 33, further comprising:

a plurality of beam former circuits each configured to provide connections substantially the same as said first beam former circuit although coupled to differing ones of said columns.

38. The system of claim 37, wherein each beam former of said plurality of beam former circuits and said first beam former circuit are coupled to at least two shared columns of said columns, wherein shared columns are coupled to at least two beam former circuits of said plurality of beam former circuits and said first beam former circuit.

* * * * *